US012442135B2

(12) United States Patent
Parenteau et al.

(10) Patent No.: US 12,442,135 B2
(45) Date of Patent: Oct. 14, 2025

(54) SCREEN CYLINDER WITH IMPROVED SLOT WIDTH PROTECTION AND METHOD OF REMOVING SOLID CONTAMINANTS FROM A SOLID SUSPENSION

(71) Applicant: KADANT BLACK CLAWSON, LLC, Lebanon, OH (US)

(72) Inventors: Daniel Parenteau, Blainville (CA); Guy Maurais, Terrebonne (CA); Mark Mouannes, Laval (CA); Peter Joseph Flynn, Loveland, OH (US); Christopher L. Demler, Lebanon, OH (US); Donald K. Greier, Dayton, OH (US)

(73) Assignee: Kadant Black Clawson LLC, Lebanon, OH (US)

( * ) Notice: Subject to any disclaimer, the term of this patent is extended or adjusted under 35 U.S.C. 154(b) by 922 days.

(21) Appl. No.: 17/605,063

(22) PCT Filed: Apr. 23, 2020

(86) PCT No.: PCT/US2020/029461
§ 371 (c)(1),
(2) Date: Oct. 20, 2021

(87) PCT Pub. No.: WO2020/219637
PCT Pub. Date: Oct. 29, 2020

(65) Prior Publication Data

US 2022/0186438 A1 Jun. 16, 2022

Related U.S. Application Data

(60) Provisional application No. 62/839,314, filed on Apr. 26, 2019.

(51) Int. Cl.
*D21D 5/16* (2006.01)

(52) U.S. Cl.
CPC ..... *D21D 5/16* (2013.01)

(58) Field of Classification Search
CPC ..... D21D 5/16
(Continued)

(56) References Cited

U.S. PATENT DOCUMENTS 8,469,198 B2 6/2013 Hetu

FOREIGN PATENT DOCUMENTS

DE 20021552 U1 3/2001
DE 202013101853 U1 5/2013
(Continued)

OTHER PUBLICATIONS

Japanese Office Action dated Mar. 21, 2024, pertaining to JP Application No. 2021-563258, 8 pgs.
(Continued)

*Primary Examiner* — Jacob T Minskey
(74) *Attorney, Agent, or Firm* — Dinsmore & Shohl LLP

(57) ABSTRACT

A screen cylinder includes a profiled bars aligned longitudinally and coupled to at least one support ring. Each of the profiled bars includes an outer surface facing away from the support ring, a first slot surface extending from the outer surface to the attachment end, and a second slot surface opposite the first slot surface and extending from the outer surface to the attachment end of the profiled bar. The first slot surface of one profiled bar and the second slot surface of another immediately adjacent profiled bar define a slot. The profiled bars include a hardened layer integral with or disposed on at least a portion of the first slot surface of the profiled bar. The hardened layer may have a Vickers hardness greater than the hardness of the base metal.

16 Claims, 8 Drawing Sheets

(58) Field of Classification Search
USPC ..... 162/201
See application file for complete search history.

(56) References Cited

FOREIGN PATENT DOCUMENTS

| | | | |
|---|---|---|---|
| JP | H05209390 | A | 8/1993 |
| JP | H07189157 | A | 7/1995 |
| JP | 2014502679 | A | 2/2014 |
| JP | 2017538870 | A | 12/2017 |
| WO | 2013029930 | A1 | 3/2013 |

OTHER PUBLICATIONS

International Search Report and Written opinion dated Jun. 18, 2020 pertaining to PCT Application No. PCT/US2020/029461 filed Apr. 23, 2020.
Chinese Office Action dated Feb. 23, 2024, pertaining to CN Patent Application No. 202080047122.X, 27 pgs.
European Patent Office, Communication Pursuant to Rules 161(1) and 162 EPC, Mar. 12, 2021, 3 pgs.
International Bureau, International Preliminary Report on Patentability, Int'l Appln. No. PCT/US2020/029461, Nov. 4, 2021, 9 pgs.
Chinese Office Action dated Aug. 13, 2023, pertaining to CN Patent Application No. 202080047122.X, 25 pgs.

SCREEN CYLINDER WITH IMPROVED SLOT WIDTH PROTECTION AND METHOD OF REMOVING SOLID CONTAMINANTS FROM A SOLID SUSPENSION

CROSS-REFERENCE TO RELATED APPLICATIONS

This application is a National Stage Entry under 35 U.S.C. § 371 of International Application No. PCT/US2020/029461, filed Apr. 23, 2020 and entitled "Screen Cylinder with Improved Slot Width Protection and Method of Removing Solid Contaminants from a Solid Suspension," which claims the benefit of priority under 35 U.S.C. § 120 of U.S. Provisional Application No. 62/839,314, entitled "Screen Cylinder with Improved Slot Width Protection," filed Apr. 26, 2019, the entire contents of both of which are hereby incorporated by reference in the present disclosure.

BACKGROUND

Field

The present specification generally relates to screen cylinders for removing oversized solid contaminants from solid suspensions and, in particular, screen cylinders having improved slot width protection and methods of making and using screen cylinders having improved slot width protection.

Technical Background

In the paper industry, processes for making paper require production of pulp, which is a solid suspension of fibers, such as cellulose fibers or other fibers. Depending on the source of the fibers, the pulp can include various concentrations and sizes of solid contaminants such as wood fragments, fiber bundles, metal pieces, hardened adhesive, or other contaminants. For example, increasing use of recycled paper as a source of the fibers may increase the presence of hardened adhesives, metal fragments, and wood fragments in the pulp. These oversized solid contaminants can decrease the quality of the paper and/or cause disruptions in the flow of the pulp in the head box of a Fourdrinier machine or other paper-making processes.

Before introducing the pulp to the paper-making process, the pulp is often screened to remove these oversized solid contaminants from the pulp. Screening the pulp may also be used to sort the pulp with respect to fiber length or fiber stiffness. Pulp screening can be accomplished by introducing the pulp to a pressure screen, in which the acceptable portions of the pulp pass through holes or slots in the screen. The solid contaminants or unacceptable portions of the pulp (e.g., long or stiff fibers if screening based on properties of the fiber) do not pass through the slots or holes in the screen and are discharged from a rejects outlet. The pressure screens may also be used for removing oversized solid contaminants from slurries and solid suspensions in other industries other than the pulp and paper industry.

SUMMARY

Accordingly, an ongoing need exists for pressure screens with improved wear performance. In particular, ongoing need exist for screen cylinders having hardened layers in slot areas to reduce wear in the slot areas.

According to one or more aspects of the present disclosure, a screen cylinder may include a plurality of profiled bars aligned longitudinally and coupled to at least one support ring at attachment ends of the plurality of profiled bars. Each of the plurality of profiled bars may include an outer surface facing away from the at least one support ring, a first slot surface extending from the outer surface to the attachment end of the profiled bar opposite the outer surface, and a second slot surface opposite the first slot surface and extending from the outer surface to the attachment end of the profiled bar. The first slot surface of one profiled bar and the second slot surface of another immediately adjacent profiled bar may define a slot. The profiled bars may further include a hardened layer integral with or disposed on at least a portion of the first slot surface of the profiled bar, the hardened layer having a Vickers hardness value greater than or equal to 500HV0.05, as determined in accordance with ASTM E384-11e1.

According to another aspect of the present disclosure, a profiled bar for a screen cylinder for separating solid contaminants from a solid suspension may include an attachment end and an outer surface disposed at an end opposite the attachment end. The profiled bar may further include a first slot surface extending from the outer surface to the attachment end of the profiled bar and a second slot surface opposite the first slot surface and extending from the outer surface to the attachment end. The profiled bar may further include a hardened layer integral with or disposed on at least a portion of the first slot surface, a portion of the second slot surface, or both, the hardened layer having a Vickers hardness value greater than or equal to 500HV0.05, as determined in accordance with ASTM E384-11e1.

According to still another aspect of the present disclosure, a method of making a hardened profiled bar for a screen cylinder may include providing a profiled bar that includes an attachment end and an outer surface facing in a direction opposite the attachment end. The profiled bar may further include a first slot surface extending from the outer surface to the attachment end of the profiled bar and a second slot surface opposite the first slot surface and extending from the outer surface to the attachment end. The method may further include forming a hardened layer on or integral with at least a portion of the first slot surface. The hardened layer may have a Vickers hardness value of greater than or equal to 500HV0.05, as determined in accordance with ASTM E384-11e1. The method may further include depositing a chrome layer on the outer surface of the profiled bar or on the hardened layer.

According to still other embodiments of the present disclosure, a method of removing solid contaminants from a solid suspension may include contacting the solid suspension with a screen cylinder. The screen cylinder may include a plurality of profiled bars coupled to at least one support ring and aligned longitudinally. Each of the plurality of profiled bars may include an outer surface facing away from the at least one support ring, a first slot surface extending from the outer surface to an attachment end of the profiled bar opposite the outer surface, and a second slot surface opposite the first slot surface and extending from the outer surface to the attachment end of the profiled bar. Each of the profiled bars may further include a hardened layer integral with or disposed on at least a portion of the first slot surface of each of the profiled bars. The hardened layer may have a Vickers hardness value greater than or equal to 500HV0.05, as determined in accordance with ASTM E384-11e1. The first slot surfaces and second slot surfaces of side-by-side pairs of profiled bars may define a plurality of slots of the screen cylinder and contact of the solid suspension with the screen cylinder may cause at least a portion of the solid suspension to pass through the slots. The method may further include collecting an acceptable solid suspension from the plurality of slots of the screen cylinder.

It is to be understood that both the foregoing general description and the following detailed description describe various embodiments and are intended to provide an overview or framework for understanding the nature and character of the claimed subject matter.

BRIEF DESCRIPTION OF THE DRAWINGS

The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Figure 1:
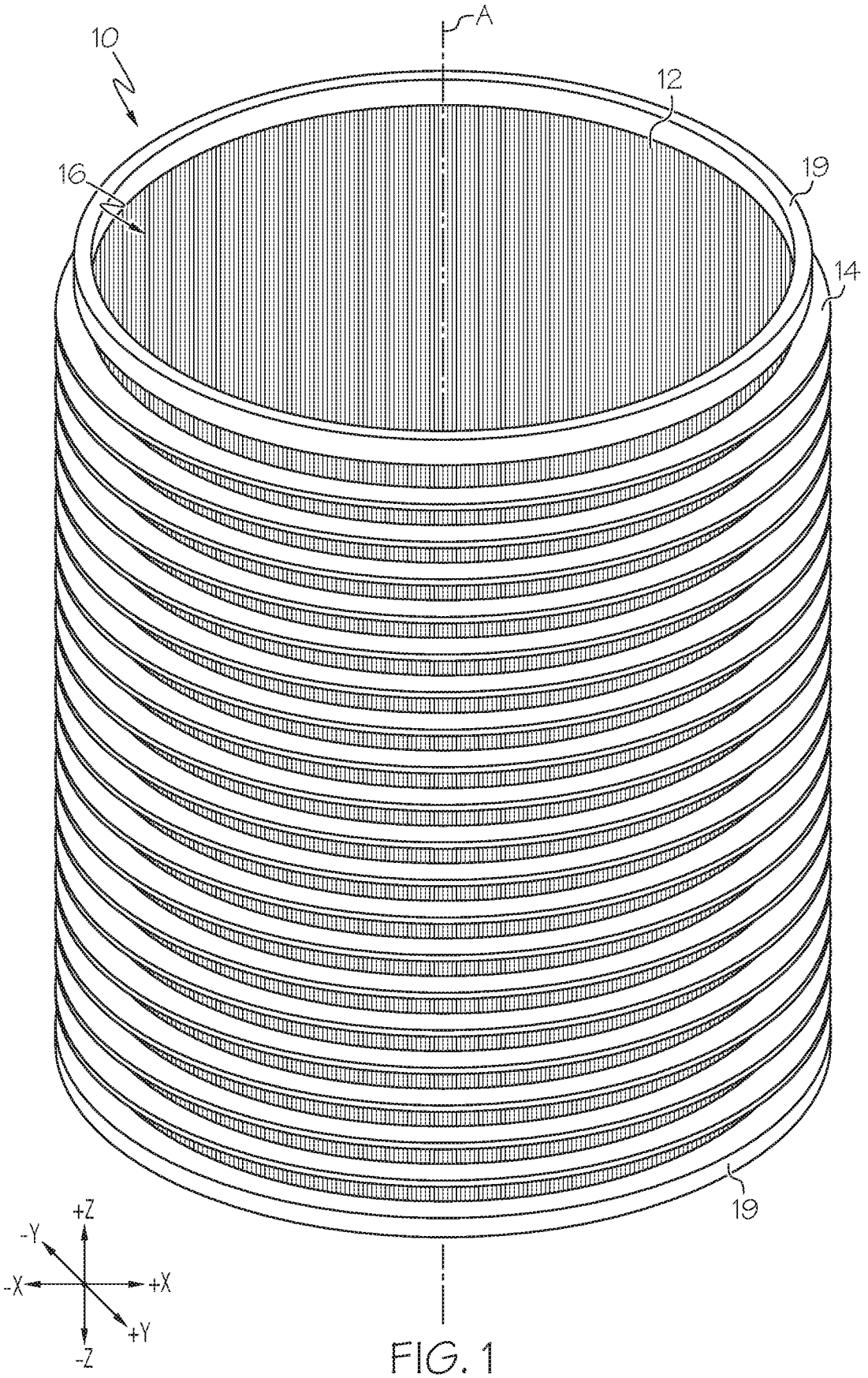
FIG. 1 schematically depicts a front perspective view of a screen cylinder, according to one or more embodiments shown and described herein.

Reference will now be made in detail to embodiments of screen cylinders having hardened, profiled bars, examples of which are illustrated in the accompanying drawings. Whenever possible, the same reference numerals will be used throughout the drawings to refer to the same or like parts. Referring to FIGS. 1 and 2, a screen cylinder 10 according to embodiments of the present disclosure is illustrated. The screen cylinder 10 may include a plurality of profiled bars 12 aligned longitudinally and coupled to at least one support ring 14 at attachment ends 30 of the plurality of profiled bars 12. Referring to FIG. 2, each of the profiled bars 12 may include an outer surface 32 facing away from the support ring 14, a first slot surface extending from the outer surface 32 to the attachment end 30 of the profiled bar 12, and a second slot surface opposite the first slot surface and extending from the outer surface 32 to the attachment end 30 of the profiled bar 12. The first slot surface of one profiled bar and the second slot surface of another immediately adjacent profiled bar may define a slot 20. Each of the profiled bars may include a hardened layer integral with or disposed on at least a portion of the first slot surface of the profiled bar 12, the hardened layer having a Vickers hardness value greater than the base metal of the profiled bar 12. In some embodiments, the profiled bars may also include a chrome layer disposed on the outer surface 32 the profiled bar 12 or on the hardened layer. During operation of the screen cylinder 10 acceptable portions of the solid suspension flow through the slots 20 in the slotted cylindrical wall 16. The hardened layer applied to the profiled bars 12 may reduce wear of the slot surfaces of the profiled bars 12 caused by the abrasive solid constituents of the solid suspension. Reducing wear may reduce widening of the slots 20 which can maintain the separation efficiency of the screen cylinder 10 over time. Reducing wear at the slot surfaces to maintain the separation efficiency of the screen cylinder 10 over time may increase the service life of the screen cylinder.

Unless otherwise expressly stated, it is in no way intended that any method set forth herein be construed as requiring that its steps be performed in a specific order, nor that specific orientations be required with any apparatus. Accordingly, where a method claim does not actually recite an order to be followed by its steps, or that any apparatus claim does not actually recite an order or orientation to individual components, or it is not otherwise specifically stated in the claims or description that the steps are to be limited to a specific order, or that a specific order or orientation to components of an apparatus is not recited, it is in no way intended that an order or orientation be inferred, in any respect. This holds for any possible non-express basis for interpretation, including: matters of logic with respect to arrangement of steps, operational flow, order of components, or orientation of components; plain meaning derived from grammatical organization or punctuation, and; the number or type of embodiments described in the specification.

Directional terms as used herein—for example up, down, right, left, front, back, top, bottom—are made only with reference to the figures as drawn and the coordinate axis provided therewith and are not intended to imply absolute orientation.

As used herein, the singular forms "a," "an" and "the" include plural referents unless the context clearly dictates otherwise. Thus, for example, reference to "a" component includes aspects having two or more such components, unless the context clearly indicates otherwise.

As used herein, the term "longitudinal" may refer to an orientation or direction generally parallel with the center axis A of the screen cylinder.

As used herein, the term "radial" may refer to a direction along any radius, which extending outward from the center axis A of the screen cylinder (FIG. 1).

As used herein, the terms "upstream" and "downstream" may refer to relative positions of features with respect to a direction of flow of the solid suspension or slurry. For the screen cylinders of the present disclosure, the flow of solid suspension is generally from the outer surfaces 32 of the profiled bars 12 towards the attachment ends 30 of the profiled bars 12.

As used herein, the term "solid contaminant" or "oversized solid contaminant" may refer to solid objects, such as wood chips, metal pieces, dried adhesives, or other contaminants, that are not intended to be and not desired in the solid suspension or slurry and may be distinguished from the solid constituents that are intended to be in the solid suspension, such as fibers for example.

Unless otherwise specified, the values for the Vickers hardness value of the base metal, hardened layer 50, and chrome layer 40 provided herein refer to the Vickers hardness value determined in accordance with ASTM E384-11e1 with an indenter load of 0.05 kilograms of force (kgf).

In the pulp and paper industry, pulp screening can be accomplished by a pressure screening process using a screen cylinder. Pressure screening processes can include introducing the solid suspension, such as a solid suspension of fibers, to a screen cylinder. The fibers can be any type of fiber, such as but not limited to cellulose fibers, cotton fibers, fiberglass fibers, or other fiber. The screen cylinder can be an inward flow screen cylinder, in which the acceptable portions of solid suspension flow radially inward through the screen cylinder, or an outward screen cylinder, in which the acceptable portions of the solid suspension flow radially outward through the screen cylinder. The screen cylinder may include a rotor or other device operable to remove the solid contaminants from the screen cylinder. Some screen cylinders for pressure screening pulp or other solid suspensions and slurries may have a unitary screen cylinder comprising a solid metal cylinder through which a plurality of holes or slots are drilled or milled. However, these unitary screen cylinders provide limited throughput through the screen due to the limited slot area through which the acceptable portions of the solid suspension can pass. The market for pulp and paper has increased the demand for greater efficiency from pulp screening processes with respect to greater throughput as well as greater ability to separate oversized solid contaminants from the solid suspension.

Figure 2A:
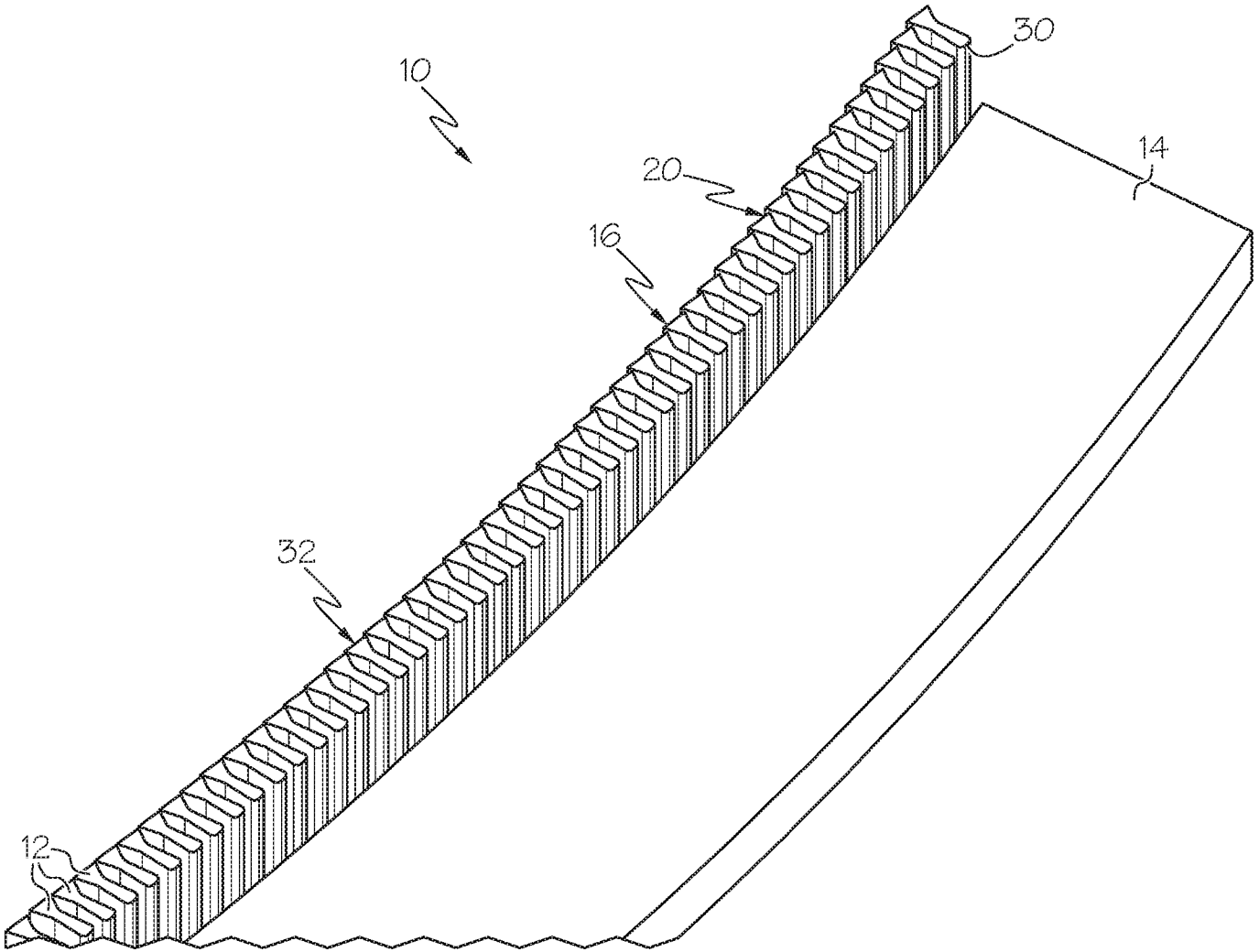
FIG. 2A schematically depicts a perspective view of a portion of the screen cylinder of FIG. 1 showing a plurality of profiled bars coupled to support rings of the screen cylinder, according to one or more embodiments shown and described herein.
Figure 2B:
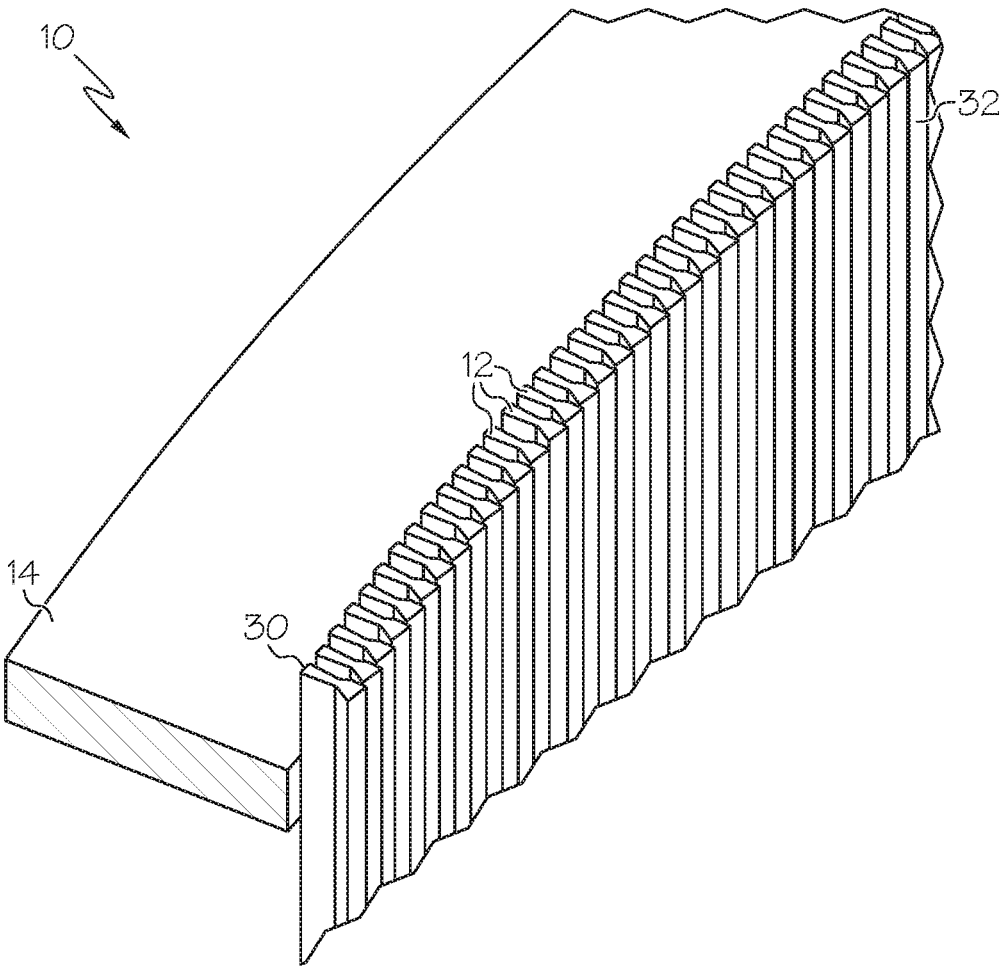
FIG. 2B schematically depicts another perspective view of a portion of the screen cylinder of FIG. 1 showing a plurality of profiled bars coupled to support rings of the screen cylinder, according to one or more embodiments shown and described herein.

To improve throughput of the pressure screening process, screen cylinders have been developed that include a plurality of longitudinally-arranged profiled bars, the profiled bars defining a plurality of slots extending the length of the screen cylinder. Referring to FIGS. 1, 2A, and 2B, a screen cylinder 10 of the present disclosure comprising a plurality of profiled bars 12 is schematically depicted. The screen cylinder 10 includes the plurality of profiled bars 12 aligned longitudinally and coupled to at least one support ring 14 at attachment ends 30 of the plurality of profiled bars 12. In some embodiments, the at least one support ring 14 may include a plurality of support rings 14. The screen cylinder 10 may also include annular end flanges 19 at either axial end of the screen cylinder 10.

Each of the profiled bars 12 may be longitudinally aligned with a center axis A of the screen cylinder 10 and with each of the other profiled bars 12. The profiled bars 12 may be arranged side-by-side along a circular inner or outer circumference of the support ring 14 to form a slotted cylindrical wall 16. The slotted cylindrical wall 16 formed by the plurality of profiled bars 12 may include slots 20 defined between each adjacent pair of profiled bars 12. The slots 20 may extend the length of the screen cylinder 10 between the two annular end flanges 19. Further features and aspects of the support structure and operation of the screen cylinders 10 of the present disclosure may be found in U.S. Pat. No. 8,469,198, the entire contents of which are incorporated by reference herein.

By having slots 20 extending the length of the screen cylinder 10, the screen cylinder 10 comprising the plurality of profiled bars 12 may generally provide increased open area through which acceptable solid suspension can flow. The greater open area provided by the slots 20 of the screen cylinder 10 may provide greater throughput through the screen cylinder 10 compared to unitary screen cylinders having the holes or slots drilled or milled into the metal cylinder. The screen cylinder 10 is depicted in FIGS. 1, 2A, and 2B as an outward flow screen cylinder 10 in which the acceptable solid suspension flows radially outward through the slots 20. However, it is understood that the features of the present disclosure may be applied equally well to an inward flow screen cylinder or any other type of pressure screen device utilizing a plurality of profiled bars. The screen cylinder 10 may be operable to separate solid contaminants from the solid suspension.

Figure 3:
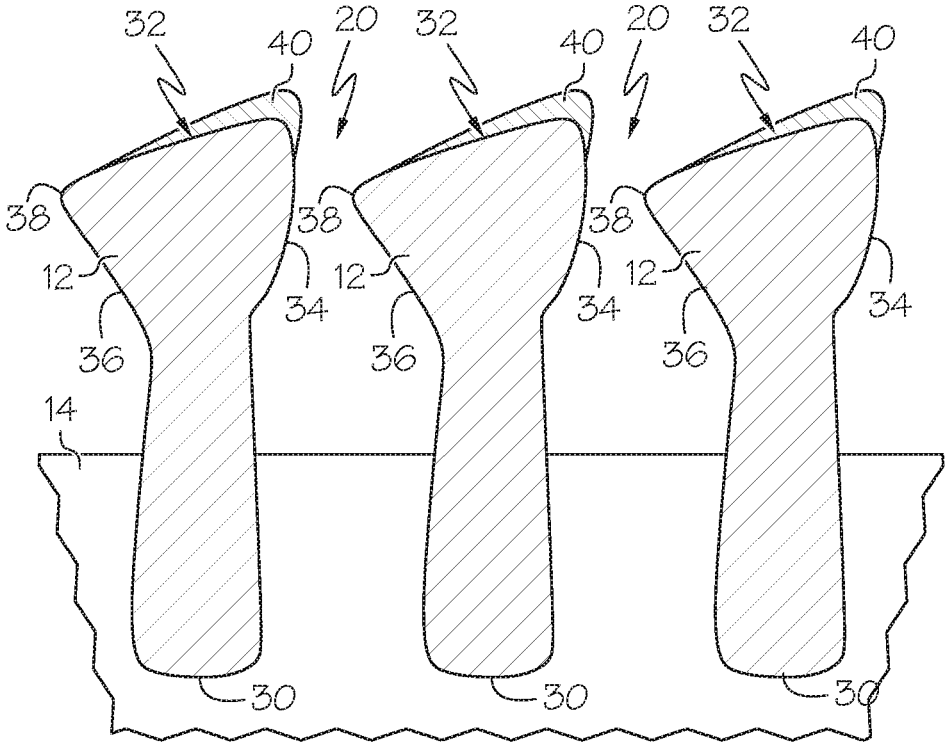
FIG. 3 schematically depicts a cross-sectional view of three profiled bars of the screen cylinder of FIG. 1, the profiled bars having a chrome layer on an outer surface of the profiled bars, according to one or more embodiments shown and described herein.

Referring to FIG. 3, an embodiment of the profiled bars 12 is depicted. Each of the profiled bars 12 may have an attachment end 30 coupled to the support rings 14. Each of the profiled bars 12 may have an outer surface 32 facing away from the at least one support ring 14. The outer surfaces 32 of the plurality of profiled bars 12 may form the slotted cylindrical wall 16 (FIG. 1) of the screen cylinder 10. Still referring to FIG. 3, each of the profiled bars 12 may have a first slot surface 34 extending from the outer surface 32 to the attachment end 30 of the profiled bar 12, which is opposite the outer surface 32. Each of the profiled bars 12 may have a second slot surface 36 on an opposite side from the first slot surface 34 and extending from the outer surface 32 to the attachment end 30 of the profiled bar 12. The first slot surface 34 of one profiled bar 12 and the second slot surface 36 of another immediately adjacent profiled bar 12 define one of the slots 20 of the screen cylinder 10. When two profiled bars 12 are referred to as "immediately adjacent," the two profiled bars 12 are side-by-side so that the first slot surface 34 of the first profiled bar and the second slot surface 36 of the second profiled bar define the slot 20 with no other profiled bars disposed between the first and the second profiled bars.

The first slot surface 34 may have a first contour, and the second slot surface 36 may have a second contour. The second slot surface 36 may meet the outer surface 32 of the profiled bar 12 at a nose 38 that protrudes towards the first slot surface 34 of the immediately adjacent profiled bar 12. At the nose 38, the second contour of the second slot surface 36 of one profiled bar 12 may converge with the first contour of the first slot surface 34 of another immediately adjacent profiled bar 12. Thus, a narrowest portion of the slot 20 may be defined between the nose 38 of the second slot surface 36 of the profiled bar 12 and the first slot surface 34 of the immediately adjacent profiled bar. Downstream of the nose 38, the second contour of the second slot surface 36 of the profiled bar 12 and the first contour of the first slot surface 34 of the immediately adjacent profiled bar 12 may diverge to widen the width of the slot 20 downstream of the nose 38. As previously discussed, the flow of the solid suspension through the slots 20 is generally from the outer surface 32 of the profiled bars 12 towards the attachments ends 30. The first contour and second contour may have shapes other than those depicted in FIG. 3. For example, in embodiments, the first slot surface 34, the second slot surface 36, or both, may comprise a smooth surface or straight surface extending from the attachment end 30 to the outer surface 32 of the profiled bars 12, or each may have a contour having a generally constant curvature from the attachment end 30 to the outer surface 32 of the profiled bars 12. It is understood that the first slot surface 34 and the second slot surface 36 may have any suitable shape for producing a screen cylinder for removing oversized solid contaminants from slurries and solid suspensions.

Referring to FIG. 3, each of the profiled bars 12 may include a chrome layer 40 applied to one or more surfaces. In particular, the profiled bars 12 may include the chrome layer 40 applied to the outer surface 32. The outer surface 32 of the profiled bars 12 may be subjected to pressure pulses from a rotor, the pressure pulses providing sufficient cleaning action to remove the oversized solid contaminants from the slotted cylindrical wall 16 (FIG. 1) of the screen cylinder 10. The chrome layer 40 on the outer surface 32 may increase the hardness of the outer surface 32 to reduce wear caused by these pressure pulsations. The chrome layer 40 may have a Vickers hardness value (HV) of from 900HV0.05 to 1000HV0.05, as determined according to ASTM E384-11e1 using an indenter load of 0.05 kilograms of force (kgf).

The chrome layer 40 may be applied to the outer surfaces 32 of the profiled bars 12 after assembly of the screen cylinder 10. The chrome layer 40 may be applied using an electroplating process. When electroplating the screen cylinder 10, the chrome is generally deposited preferentially at regions having the lowest resistance to the flow of electricity, which is generally the outer surfaces 32 of the parallel bars 12. Because the chrome deposits on the surfaces having the least electrical resistance, the chrome layer 40 can be inconsistent and non-uniform across the entire peripheral surface of the profiled bars 12. As depicted in the FIG. 3, the chrome layer 40 can be thicker in regions of low electrical resistance and thinner or nonexistent in regions of greater electrical resistance. For these reasons, it can be difficult to deposit the chrome layer 40 on the first slot surface 34 and/or the second slot surface 36 of the profiled bars 12, which have greater resistance to flow of electricity compared to the outer surface 32 of the profiled bars 12 due to geometric considerations. As a result, the chrome layer 40 on the first slot surface 34 and/or the second slot surface 36 may be very thin or even non-existent.

The screen cylinder 10 could be subjected to electroplating for a period of time sufficient to build-up a chrome layer 40 on the first slot surface 34 and second slot surface 36. However, chrome plating is very expensive and use of chrome and environmental regulation of chrome processes are increasing. Additionally, prolonged exposure to the electroplating process may only result in greater non-uniformity of the chrome layer 40. The non-uniformity of the chrome layer 40 may result in variations in the slot width from one slot 20 to the next and along the longitudinal length of the slots 20. Even if the chrome layer 40 on each of the plurality of profiled bars 12 is deposited before assembly of the screen cylinder 10, chrome layer 40 may still be non-uniform, resulting in variable thickness of the chrome layer 40 over all the peripheral surfaces of the profiled bars 12. Grinding the chrome layer 40 after electroplating to produce a more uniform chrome layer 40 can be labor intensive and can result in waste of the high-cost chrome electroplated onto the surfaces of the profiled bars 12.

The inconsistency in the chrome layer 40 produced through electroplating can result in portions of the first slot surface 34 and the second slot surface 36 having thin chrome layers 40 or no chrome layer 40 deposited thereon. A thin chrome layer 40 may provide some initial protection from wear, but thin chrome layers 40 may wear off to expose the base metal underneath. When no chrome layer 40 is formed on the slot surfaces, the base metal, which may have a Vickers hardness value of less than or equal to 400HV0.05, may be exposed directly to the abrasive flow of the solid suspension through the slot 20. In either case (e.g., thin chrome layer 40 or no chrome layer 40 on the first slot surface 34 and/or the second slot surface 36), the first slot surface 34 and/or the second slot surface 36 may experience excessive wear during operation of the screen cylinder 10, altering the width of the slot and decreasing the separation efficiency of the screen cylinder 10.

Figure 4:
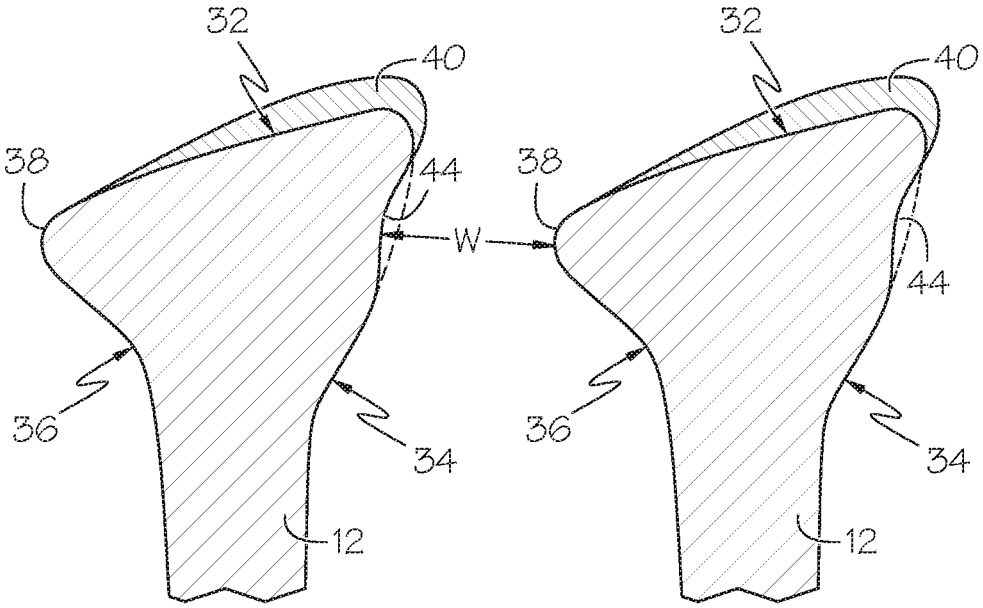
FIG. 4 schematically depicts a cross-sectional view of a portion of the profiled bars of FIG. 3 after a term of service in which a portion of a first slot surface of the profiled bar has worn away, resulting in a larger slot, according to one or more embodiments shown and described herein.

Referring to FIG. 4, a typical wear pattern for the profiled bars 12 is schematically depicted. In FIG. 4, the dashed lines represent the original contour of the first slot surface 34 before introducing the screen cylinder 10 into service and the solid lines represent the contour of the first slot surface 34 after a period of use of the screen cylinder 10. As shown in FIG. 4, wear may be greatest at a portion of the first slot surface 34 directly across the slot 20 from the nose 38 of the immediately adjacent profiled bar 12. As the first slot surface 34 wears in the region proximate the nose 38 of the immediately adjacent profiled bar 12, the slot width W may increase over time. The increasing slot width W may increase the throughput of the screen cylinder 10, but may also reduce the efficiency of the screen cylinder 10 for separating oversized solid contaminants from the solid suspension. Thus, wear may cause an increase in the concentration and/or average size of the solid contaminants and debris passing through the screen cylinder 10 and into the acceptable solid suspension downstream of the screen cylinder 10. As a result, when used to remove solid contaminants from a solid suspension of cellulose fibers or other solid constituents, the screen cylinder 10 having a thin or non-existent chrome layer 40 on the first slot surface 34 and/or the second slot surface 36 may have a reduced service life. In some cases, the service life may be reduced to only 3 to 12 months. Thus, there is a need to improve the hardness of the first slot surface 34, the second slot surface 36, or both in the area of the slot 20 to reduce wear and maintain the separation efficiency of the screen cylinder 10, which may increase service life of the screen cylinder 10.

Figure 5:
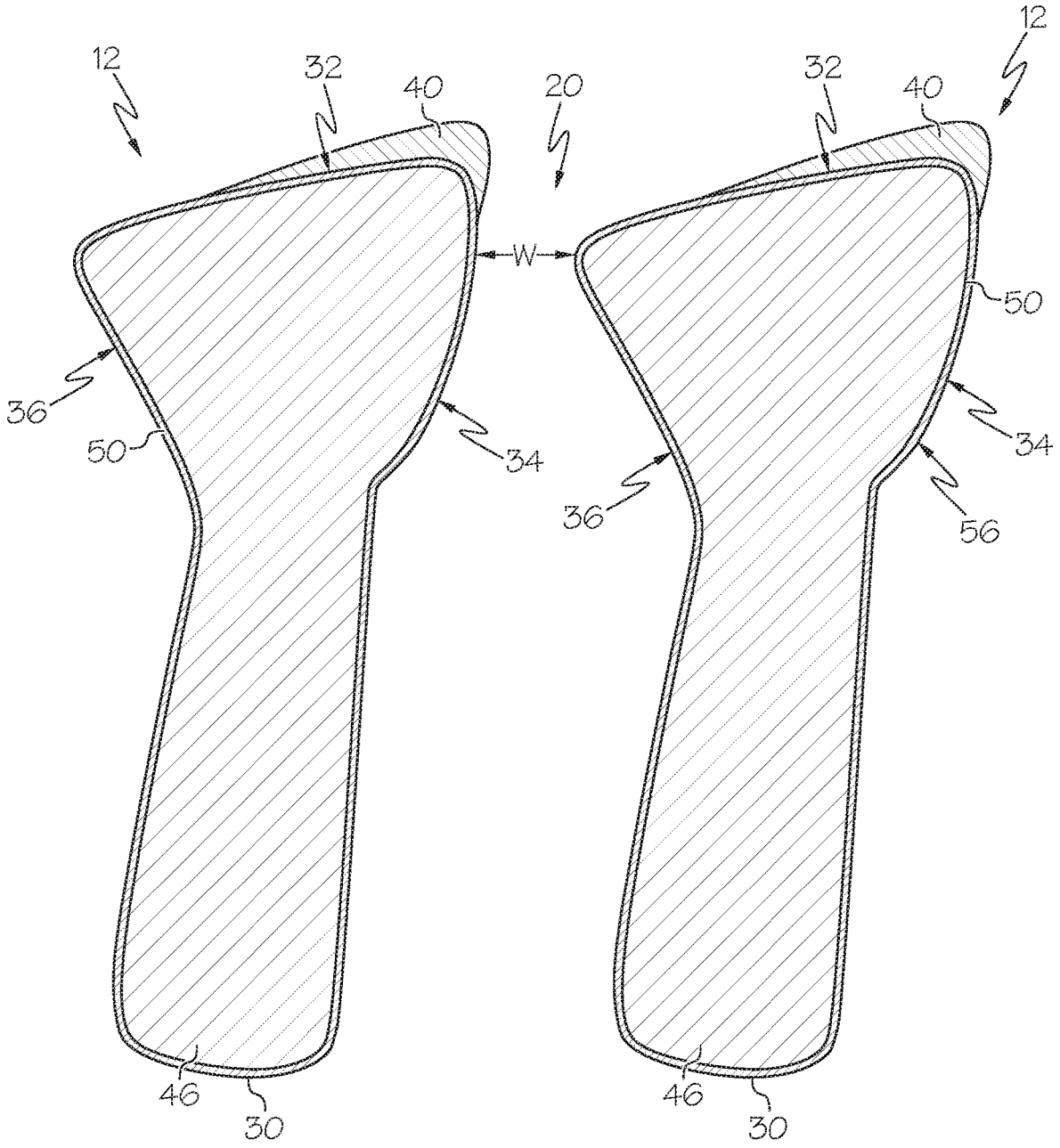
FIG. 5 schematically depicts a cross-sectional view of a profiled bar having a hardened layer and a chrome layer deposited on the hardened layer, according to one or more embodiments shown and described herein.

As previously discussed, the present disclosure is directed to profiled bars 12 having a hardened layer that can reduce wear of at least the first slot surface 34 and screen cylinders 10 that include the profiled bars 12. Referring to FIG. 5, the profiled bars 12 for a screen cylinder 10 for separating solid contaminants from a solid suspension of the present disclosure may include the attachment end 30, the outer surface 32 disposed at an end opposite the attachment end 30, the first slot surface 34 extending from the outer surface 32 to the attachment end 30 of the profiled bar 12, and the second slot surface 36 opposite the first slot surface 34 and extending from the outer surface 32 to the attachment end 30. The profiled bars 12 of the present disclosure further include a hardened layer 50 that may be integral with or disposed on at least a portion of the first slot surface 34, a portion of the second slot surface 36, or both, the hardened layer 50 may have a Vickers hardness value greater than the Vickers hardness of the base metal of profiled bars 12. The hardened layer 50 may have a Vickers hardness value greater than or equal to 500HV0.05, greater than or equal to 700HV0.05, greater than or equal to 900HV0.05, greater than or equal to 1000HV0.05, greater than or equal to 1100HV0.05, or even greater than or equal to 1200HV0.05. In some embodiments, the profiled bars 12 may additionally include a chrome layer 40 disposed on the outer surface 32 (such as when the hardened layer 50 is integral with the base metal 46) or on the hardened layer 50 (such as when the hardened layer 50 is coated on the outer surface 34 of the base metal 46). Accordingly, it should be understood that the chrome layer 40 is different than the hardened layer 50 and may be deposited onto the hardened layer 50. In some embodiments, the profiled bars 12 may include the hardened layer 50 without the chrome layer 40.

As shown in FIG. 5, when the plurality of the profiled bars 12 are arranged longitudinally and side-by-side, the first slot surface 34 of one profiled bar 12 and the second slot surface 36 of another immediately adjacent profiled bar 12 define one of the slots 20 of the screen cylinder 10. The slot 20 may have a slot width W sufficient to allow a portion of the solid suspension to pass through the slot 20 while preventing passage of oversized solid contaminants. The slot 20 may have a slot width W that is the shortest distance between the first slot surface 34 of one profiled bar 12 and the second slot surface 36 of the immediately adjacent profiled bar 12. For a screen cylinder 10 for screening paper pulp, the slot 20 may have a slot width W that is greater than or equal to 80 microns (0.08 mm), such as from 0.08 mm to 1.5 mm. The slot widths W disclosed herein are generally acceptable for screening paper pulp. However, for applications in other industries such as but not limited to mining and drilling, food processing, water treatment, or other industry, it is understood that the spacing between profiled bars 12 and slot widths W may be larger or smaller depending on the specific industry application. The slot width W of the slot 20 may be consistent along the longitudinal length of the profiled bars 12. In some embodiments, the slot width W of the slots 20 may vary within a tolerance having a magnitude of less than or equal to 15 microns, less than or equal to 10 microns, less than or equal to 8 microns, less than or equal to 7 microns, or even less than or equal to 6 microns when the screen cylinder 10 is fully assembled.

Each of the profiled bars 12 may include a base metal 46. The base metal 46 may be a rigid metal having strength sufficient to withstand the pressure pulses from the rotor without deforming or breaking. In some embodiments, the base metal 46 may be stainless steel, such as 304 stainless steel or 316 stainless steel. The base metal 46 without the hardened layer 50 may have a Vickers hardness value less than the Vickers hardness value of a chrome layer 40, the hardened layer 50, or both. In some embodiments, the base metal 46 may have a Vickers hardness of less than 500HV0.05, less than or equal to 450HV0.05, even less than or equal to 425HV0.05, or even less than or equal to 400HV0.05. In some embodiments, the base metal 46 may be non-annealed.

Figure 6A:
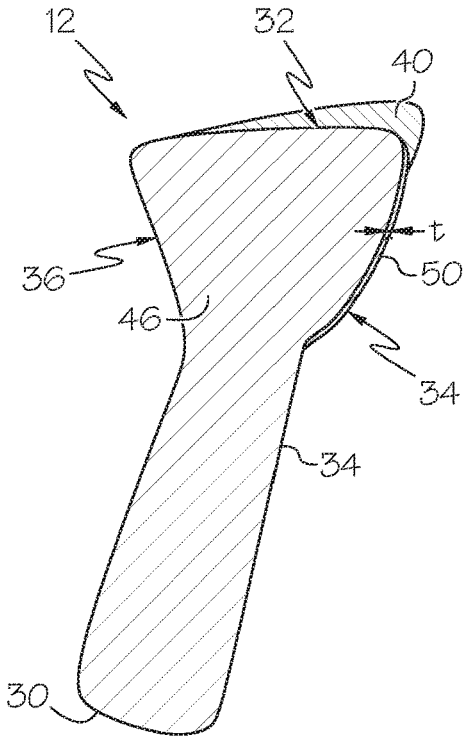
FIG. 6A schematically depicts a cross-sectional view of a profiled bar having a hardened layer on a portion of a first slot surface of the profiled bar and a chrome layer on top of the hardened layer, according to one or more embodiments shown and described herein.

Referring again to FIG. 5, the hardened layer 50 may be integral with or disposed on the base metal 46 of the profiled bars 12. The hardened layer 50 may be disposed at any portion of the first slot surface 34, the second slot surface 36, the outer surface 32, or combinations of these. Referring to FIG. 6A, in some embodiments, the hardened layer 50 may be integral with or disposed on at least a portion of the first slot surface 34 of the profiled bar 12. As previously discussed, the first slot surface 34 proximate the nose 38 of the immediately adjacent profiled bar 12 may be the region of the peripheral surface of the profiled bar 12 that experiences the greatest wear from flow of the solid suspension through the slot 20. The hardened layer 50 may also be integral with or disposed on portions of the outer surface 32, the second slot surface 36, or both, of each of the profiled bars 12.

Figure 6B:
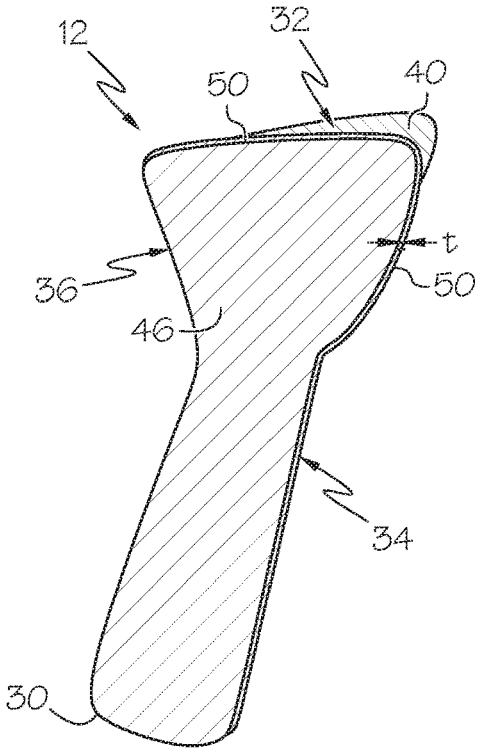
FIG. 6B schematically depicts a cross-sectional view of a profiled bar having a hardened layer on a first slot surface and an outer surface of the profiled bar and a chrome layer formed on the hardened layer, according to one or more embodiments shown and described herein.
Figure 6C:
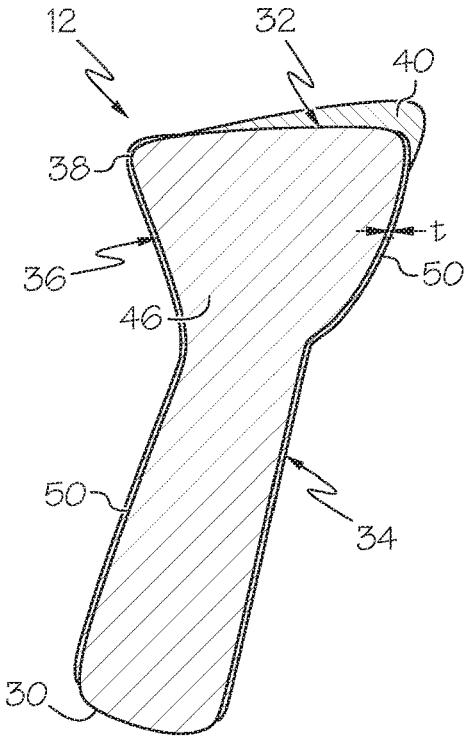
FIG. 6C schematically depicts a cross-sectional view of a profiled bar having a hardened layer on a first slot surface and on a second slot surface of the profiled bar, according to one or more embodiments shown and described herein.
Figure 6D:
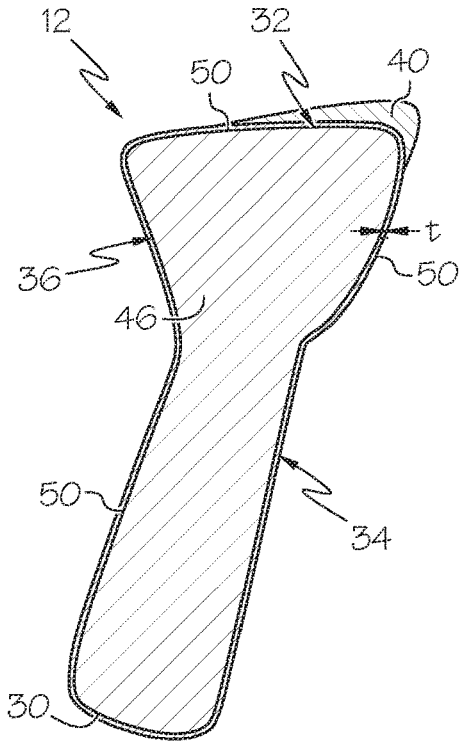
FIG. 6D schematically depicts a cross-sectional view of a profiled bar having a hardened layer on an entire peripheral surface of the profiled bar and a chrome coating applied to the hardened layer, according to one or more embodiments shown and described herein.

Referring to FIG. 6B, in some embodiments, the hardened layer 50 may be integral with or disposed on the first slot surface 34 and the outer surface 32 of the profiled bar 12. When present, the chrome layer 40 may be deposited on top of the hardened layer 50 at the outer surface 32 of the profiled bar 12. Referring to FIG. 6C, in some embodiments the hardened layer 50 may be integral with the first slot surface 34 and the second slot surface 36. The hardened layer 50 on the second slot surface 36 may extend over the nose 38 of the profiled bar 12. When present, the chrome layer 40 may be formed on the outer surface 32 of the profiled bar 12 and on portions of the hardened layer 50 proximate the outer surface 32. Referring to FIG. 6D, in some embodiments, the hardened layer 50 may be integral with or disposed on the entire peripheral surface of each of the profiled bars 12, the entire peripheral surface including at least the outer surface 32, the first slot surface 34, and the second slot surface 36. As used herein, the term "entire peripheral surface" may refer to the hardened layer 50 being integral with or disposed on at least 80%, at least 85%, at least 90%, at least 95%, or at least 99% of the peripheral surfaces of the profiled bar 12. In some embodiments, the hardened layer 50 may be integral with or disposed on at least 20%, at least 50%, at least 75%, at least 80%, at least 85%, at least 90%, at least 95%, or at least 99% of the peripheral surfaces of the profiled bar 12.

The hardened layer 50 may have a thickness sufficient to protect the first slot surface 34 and/or the second slot surface 36 from abrasive components of the solid suspension passing through the slots 20 to reduce or prevent wear of the profiled bars 12 at the first slot surface 34 and/or the second slot surface 36. For example and without limitation, the hardened layer 50 may have a thickness greater than or equal to 5 microns, greater than or equal to 10 microns, greater than or equal to 15 microns, or even greater than or equal to 20 microns. In embodiments, the hardened layer 50 may have a thickness of from 5 microns to 300 microns, from 5 microns to 250 microns, from 5 microns to 200 microns, from 5 microns to 100 microns, from 5 microns to 50 microns, from 5 microns to 30 microns, from 10 microns to 300 microns, from 10 microns to 100 microns, or from 10 microns to 50 microns. In some embodiments, the hardened layer 50 may have a thickness of greater than 300 microns without departing from the scope of the present disclosure.

The hardened layer 50 may have a hardness sufficient to reduce wear of the first slot surface 34 and/or the second slot surface 36 during operation of the screen cylinder 10. The hardened layer 50 may have a hardness greater than the hardness of the base metal 46 of the profiled bars 12. For example, the hardened layer 50 may have a Vickers hardness value greater than the Vickers hardness value of cold-rolled stainless steel, which is about 400HV0.05. In embodiments, the hardened layer 50 may have a Vickers hardness value greater than or equal to 500HV0.05, greater than or equal to 700HV0.05, greater than or equal to 900HV0.05, greater than or equal to 1000HV0.05, greater than or equal to 1100HV0.05, or even greater than or equal to 1200HV0.05. The hardened layer 50 may have a Vickers hardness value of from 500HV0.05 to 5000HV0.05, from 700HV0.05 to 2000HV0.05, or even from 1000HV0.05 to 1500HV0.05. The Vickers hardness values may be determined through measurements performed in accordance with standard test method ASTM E384-11e1.

Referring again to FIG. 5, the hardened layer 50 may have a hardened layer outer surface 56 that is dimensionally consistent and smooth. Providing a hardened layer 50 with a hardened layer outer surface 56 that is dimensionally consistent and smooth may provide for a more consistent slot width W along the length of the screen cylinder 10, as well as a more consistent slot width W from one slot 20 to the next. The hardened layer 50 having a hardened layer outer surface 56 with a smoother surface finish may also reduce the resistance to flow of the acceptable portions of the solid suspension through slots 20 and promote greater flow rate of acceptable portions of the solid suspension through the screen cylinder 10. In other words, the smoother surface finish of the hardened layer outer surface 56, as compared to the base metal or the chrome layer 40, may enable the solids (e.g., fibers) of the acceptable portion of the solid suspension to flow more easily through the slots 20, thus, increasing throughput of the screen cylinder 10 while maintaining efficient separation of oversized solid contaminants from the solid suspension.

The dimensional consistency and smoothness of the hardened layer outer surface 56 may be a function of the variability in the thickness of the hardened layer 50. In some embodiments, the hardened layer 50 may have a standard deviation in the thickness of the hardened layer 50 of less than or equal to 5 microns, less than or equal to 2 microns, less than or equal to 1 micron, or even less than or equal to 0.5 microns. The smoothness of the surface finish of the hardened layer outer surface 56 may be quantified by the surface roughness Ra value of the hardened layer outer surface 56. In some embodiments, the hardened layer outer surface 56 may have a surface roughness Ra that is less than a surface roughness Ra of the base metal 46 prior to forming the hardened layer 50. In some embodiments, the hardened layer outer surface 56 may have a surface roughness Ra that is less than the surface roughness Ra of the base metal 46 by a magnitude of greater than or equal 0.025 microns, greater than or equal to 0.030 microns, greater than or equal to 0.050 microns, or even greater than or equal to 0.100 microns. In some embodiments, the hardened layer outer surface 56 may have a surface roughness Ra of from 0.08 to 0.30 microns, from 0.09 to 0.25 microns, or from 0.09 to 0.20 microns. The surface roughness Ra of the hardened layer outer surface 56 and/or base metal 46 prior to application of the hardened layer 50 may be determined according standard test methods known in the art, such as ASTM A 480/480 M. As previously discussed, the decreased surface roughness of the hardened layer outer surface 56 may provide a smoother surface finish to the profiled bars 12, which may promote increases in the flow rate of the acceptable portion of the solid suspension through the screen cylinder 10.

In some embodiments in which a chrome layer 40 may be applied, the hardened layer 50 may have an electrical conductivity that is similar to or slightly less than the electrical conductivity of the base metal 46 and of the other metal parts of the screen cylinder 10 to reduce differences in electrical resistance during the electroplating process for forming the chrome layer 40 over the hardened layer 50. In some embodiments, the hardened layer 50 may have electrical conductivity that is the same as the electrical conductivity of the base metal 46 of the plurality of profiled bars 12. In some embodiments, the hardened layer 50 may have electrical conductivity that is within 10% of the electrical conductivity of the base metal 46. The same or similar electrical conductivity may allow the chrome layer 40 to be electroplated onto the hardened layer 50. As previously discussed, during the electroplating to produce the chrome layer 40, the chrome deposits preferentially at regions of least electrical resistance (e.g., regions of greatest electrical conductivity). Thus, if the conductivity of the hardened layer 50 is substantially less than the conductivity of the base metal 46 or other metal parts of the screen cylinder 10, then the chrome may preferentially deposit on the base metal 46 or other metal parts having greater conductivity and less electrical resistance rather than on the hardened surfaces of the profiled bars 12, such as the outer surface 32 of the profiled bars 12. If the electrical conductivity of the hardened layer 50 is substantially less than the base metal 46 or other metal components of the screen cylinder 10, then the chrome layer 40 formed on the hardened layer 50 at the outer surface 32 of the profiled bars 12 may be very thin or non-existent, the chrome having been preferentially deposited on metals having greater electrical conductivity. If the electrical conductivity of the hardened layer 50 is less than but within 10% of the electrical conductivity of the base metal 46, then the chrome layer 40 may deposit on the hardened layer 50, but the chroming process may require additional time and/or the chrome layer 40 may have a lesser thickness compared to chroming the base metal 46 without the hardened layer 50. In some embodiments in which the chrome layer 40 is not added, the hardened layer 50 may have electrical conductivity that is different than the electrical conductivity of the base metal 46 by more than 10%.

Figure 7:
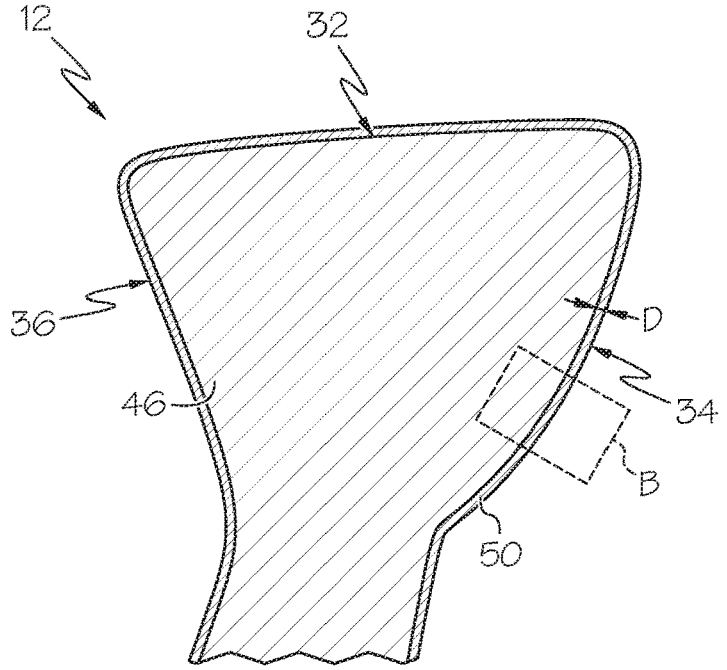
FIG. 7 schematically depicts a cross-sectional view of a portion of a profiled bar in which a hardened layer is formed integral with a base metal of the profiled bar, according to one or more embodiments shown and described herein.

Referring to FIG. 7, in some embodiments, the hardened layer 50 may be integral with the base metal 46. As used herein, the term "integral with" refers to the hardened layer 50 being a part of and inseparable from the base metal 46 (as opposed to a hardened layer 50 that is coated on the base metal 46). A hardened layer 50 that is integral with the base metal 46 at one or more surfaces can be distinguished from a hardened layer 50 that is a coating, which is a separate material from the base metal 46 and is applied onto a surface of the base metal 46 and attached or adhered thereto. The hardened layer 50 may be formed integral with the base metal 46 by surface treating the base metal 46 to modify a portion of the base metal 46 proximate the surface to form the hardened layer 50. Thus, the hardened layer 50 may include a surface treated layer of the base metal 46 of the profiled bars 12. As shown in FIG. 7, in some embodiments, the profiled bars 12 may include the hardened layer 50 and may not have a chrome layer applied to the hardened layer 50 or to the outer surface 32 of the profiled bar 12.

Treating the surface of the base metal 46 to form the hardened layer 50 may include diffusing one or more chemical constituents into the base metal 46, where diffusion of the chemical constituents into the surface of the base metal 46 may change the structure and/or properties of the base metal 46 proximate the outer surface to form the hardened layer 50. Examples of surface treatments that diffuse chemical constituents into the surface of the base metal 46 may include, but are not limited to, nitriding processes, nitrocarburizing processes, boriding processes (i.e., diffusing boron into the surface of the base metal 46), or other diffusion-based surface treatments. In nitriding processes, nitrogen from one or more nitrogen-containing compounds may be diffused under elevated temperature and pressure into the surface of the base metal 46. Nitriding processes may include gas-nitriding process in which the base metal 46 may be exposed to a gaseous composition comprising gaseous nitrogen-containing compounds, such as but not limited to nitrogen gas ($N_2$), ammonia gas ($NH_3$), nitrogen plasma, or other nitrogen-containing gases. Alternatively, nitriding may also be conducted using a liquid bath containing one or more molten nitrogen-containing salts, such as, but not limited to, an alkali cyanate salts.

During a nitrocarburization processes, both nitrogen and carbon, such as from carbon dioxide, carbonates, or other carbon-containing compounds, may be diffused into the surface of the base metal 46. Nitrocarburization processes may also be gas phase or liquid phase processes. For boriding processes, boron or boron-containing compounds may be diffused into the surface of the base metal 46. In some embodiments, the hardened layer 50 integral with the base metal 46 may include nitride ions. In some embodiments, the hardened layer 50 integral with the base metal 46 may include nitrogen, carbon, boron, or combinations of these diffused into the surface of the base metal 46.

Surface treating the base metal 46 to diffuse nitrogen, carbon, boron, or combinations of these into the surface of the base metal 46 may change the structure of the base metal 46 proximate the surface. This change in structure may increase the hardness of the base metal 46 proximate the surface, resulting in formation of the hardened layer 50 integral with the base metal 46. When the hardened layer 50 is integral with the base metal 46, the hardened layer outer surface 56 may be congruent with the peripheral surfaces of the base metal 46 (e.g., the outer surface 32, the first slot surface 34, and/or the second slot surface 36 of the profiled bars 12).

The hardened layer 50 integral with the base metal 46 may have a depth D in the base metal 46 that may be sufficient to increase the hardness of the base metal 46. In some embodiments, the depth D of the hardened layer may be sufficient to enable some material to be removed from the hardened layer outer surface 56 through electropolishing while maintaining sufficient increased hardness to reduce wear of the hardened layer outer surface 56. Electropolishing may be conducted after the surface treatment to prepare the hardened layer outer surface 56 for the chrome electroplating process for producing the chrome layer 40, when present. The hardened layer 50 integral with the base metal 46 may have a depth D within the base metal 46 of greater than or equal to 5 microns, greater than or equal to 10 microns, greater than or equal to 15 microns, or even greater than or equal to 20 microns. Examples of surface treatment processes for forming the hardened layer 50 integral with the base metal 46 may include, but are not limited to, hardening processes conducted by BodyCote of the United Kingdom, Nitrex Metal Inc. of Quebec, Canada, Expanite A/S of Cleveland, Ohio, Burlington Engineering, Inc. of Orange County, California, and other hardening processes.

In some embodiments, the hardened layer 50 integral with the base metal 46 may be formed by a nitriding process in which nitrogen is diffused into the surface of the base metal 46. In some embodiments, the hardened layer 50 integral with the base metal 46 may be formed by exposing the base metal 46 to a nitrogen-containing environment at a temperature and pressure sufficient to diffuse nitrogen into the surface of the base metal 46. As previously discussed, the nitrogen-containing environment may be a vapor phase (e.g., gases including ammonia gas) or liquid phase (e.g., bath of molten salts including alkali cyanates). During the nitriding process, the profiled bars 12 may be maintained in the ammonia atmosphere (e.g., ammonia vapor or ammonia bath) at a temperature of from about 175° C. to about 700° C., such as from 175° C. to 250° C., from 200° C. to 600° C., from 200° C. to 550° C., or from 350° C. to 550° C. In some embodiments, the temperature of the nitriding process may be maintained at a temperature less than an annealing temperature of the base metal 46. Annealing the base metal 46 may reduce the strength of the base metal 46, which can result in deformation of the profiled bars 12 during assembly or use. Additionally, excessive temperature may cause the profiled bars 12 to deform during the nitriding process, necessitating further processing of the profiled bars 12 or discarding the profiled bars 12 due to out-of-specification material. In some embodiments, the base metal 46 of each of the profiled bars 12 may be non-annealed following the nitriding process. The profiled bars 12 may be maintained in the ammonia atmosphere at the nitriding temperature for a period of from 5 minutes to 50 hours, such as from 1 hour to 50 hours, or from 1 hour to 20 hours. The nitriding process may be conducted at ambient pressure or at pressures greater than ambient pressure.

Figure 8:
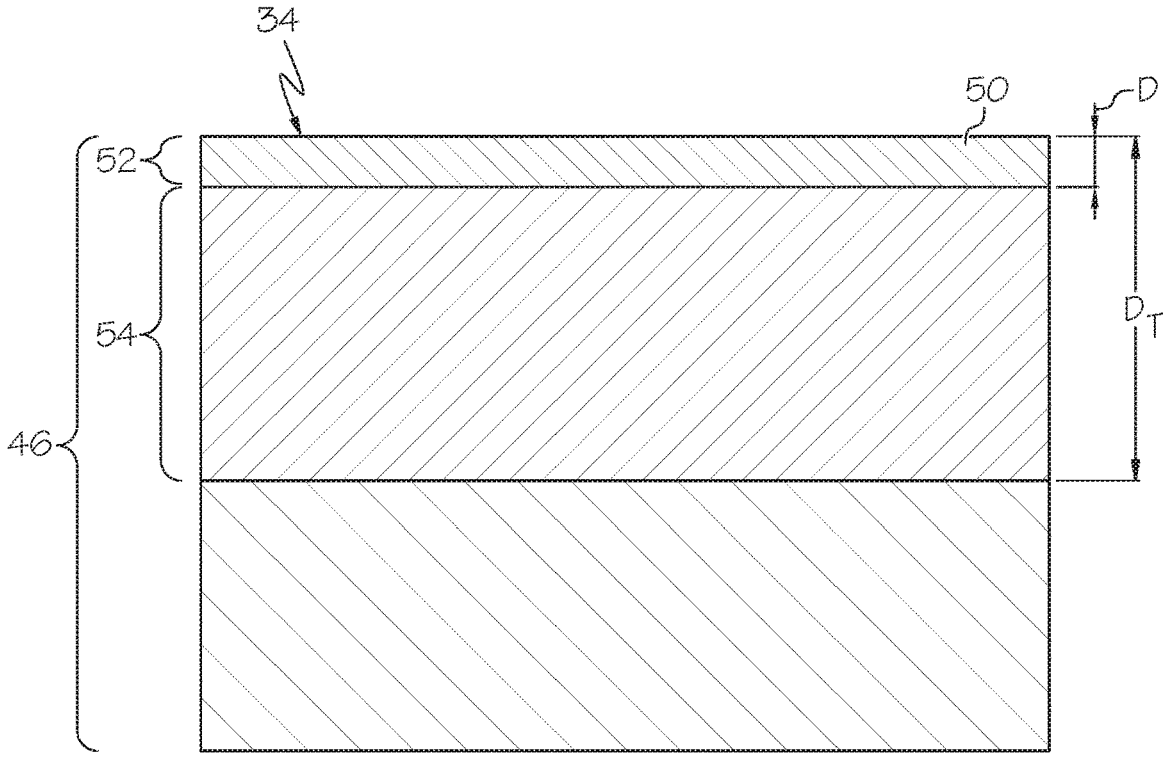
FIG. 8 schematically depicts a cross-sectional view of a portion of the hardened layer of the profiled bar of FIG. 7, according to one or more embodiments shown and described herein.

Referring to FIG. 8, the nitriding process may result in the formation of a compound layer 52 at the surface 47 of the base metal 46. The compound layer 52 may be characterized by a change in the structure of the base metal 46 to epsilon-phase (ε-phase), gamma-phase (γ-phase), or combinations of these. The compound layer 52 may provide hardness to the base metal 46, thus, forming the hardened layer 50 integral with the base metal 46. The compound layer 52 may extend to the depth D within the surface of the base metal 46. The depth D of the compound layer 52 may be greater than or equal to 5 micron, greater than or equal to 10 microns, greater than or equal to 15 microns, or even greater than or equal to 20 microns. For example, the depth D of the compound layer 52 after nitriding may be from 5 microns to 30 microns, from 10 microns to 30 microns, or from 15 microns to 25 microns. As shown in FIG. 8, the nitride ions may diffuse further into the base metal 46 to form a diffusion zone 54 extending from the compound layer 52 further into the base metal 46 to a diffusion depth $D_T$. The diffusion zone 54 may extend to a diffusion depth $D_T$ of up to 0.1 mm or even up to 0.5 mm. The thicknesses of the compound layer 52 and diffusion zone 54 may be determined in accordance with ASTM B487-85 (2007).

One or more of the surfaces of the base metal 46, such as the outer surface 32, the first slot surface 34, second slot surface 36, or combinations of these may be subjected to nitriding, nitrocarburizing, boriding, or other surface treatment processes to produce the hardened layer 50 integral with the base metal 46. In some embodiments, the entire profiled bar 12 may be subjected to the nitriding, nitrocarburizing, boriding, or other surface treatment process so that the entire peripheral surface, including the outer surface 32, first slot surface 34, and second slot surface 36, include the hardened layer 50 integral with the base metal 46. Thus, the diffusion-based surface treatments can produce a hardened layer 50 that extends over the entire peripheral surface of the profiled bars 12.

The hardened layer 50 integral with the base metal 46 formed by nitriding, nitrocarburizing, boriding, or other surface treatment may have a Vickers hardness value greater than the base metal 46. In some embodiments, the hardened layer 50 integral with the base metal 46 may have a Vickers hardness value greater than a Vickers hardness value of the chrome layer 40. The hardened layer 50 integral with the base metal 46 may have a Vickers hardness of greater than or equal to 900HV0.05, greater than or equal to 1000HV0.05, greater than or equal to 1100HV0.05, or even greater than or equal to 1200HV0.05. In some embodiments, the hardened layer 50 integral with the base metal 46 and formed by nitriding, nitrocarburizing, boriding, or other surface treatment may have a Vickers hardness value of greater than or equal to 1400HV0.05.

Treating the surface of the profiled bar 12 through nitriding, nitrocarburization, boriding, or other process may also produce a hardened layer 50 having a surface roughness Ra less than the surface roughness Ra of the base metal 46 before treating the base metal 46 to form the hardened layer. In some embodiments, the hardened layer 50 integral with the base metal 46 may have a surface roughness Ra that is at least 0.025 microns, at least 0.030 microns, at least 0.050 microns, or even at least 0.100 microns less than the surface roughness Ra of the base metal 46 before surface treatment to form the hardened layer 50. As previously discussed, reducing the roughness of the first slot surface 34 and second slot surface 36 may reduce resistance to flow through the slots 20, which may improve the throughput of the screen cylinder 10 while maintaining the separation efficiency.

Since the hardened layer 50 integral with the base metal 46 is produced by modifying the base metal 46, the hardened layer 50 integral with the base metal 46 formed by nitriding, nitrocarburizing, boriding, or other surface treatment process may have an electrical conductivity that is within 10% of the electrical conductivity of the base metal 46 prior to treatment to form the hardened layer 50. Forming the hardened layer 50 integral with the base metal 46 also may not result in a change in the geometry of the profiled bars 12. Thus, the profiled bars 12 having hardened layers 50 formed integral with the surfaces of the profiled bars 12 may be interchangeable into standard assemblies without making changes to the support rings 14 or other structures for holding the profiled bars 12 in place. Additionally, the hardened layer 50 integral with the base metal 46 may have good bonding with the chrome layer 40 and may exhibit reduced corrosion properties.

Figure 9:
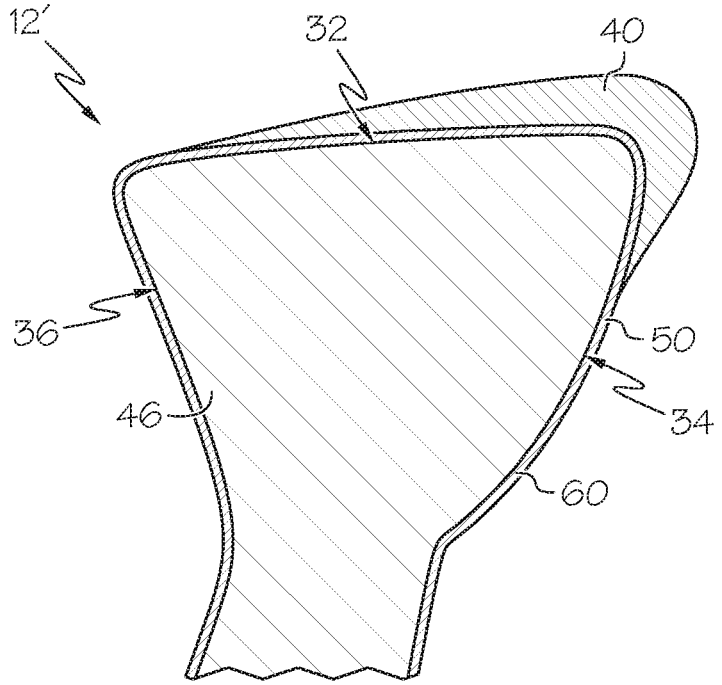
FIG. 9 schematically depicts a cross-sectional view of a portion of a profiled bar in which a hardened layer comprises a coating applied to at least a first slot surface, a second slot surface, and an outer surface of the profiled bar, according to one or more embodiments shown and described herein.

Referring now to FIG. 9, in some embodiments, the hardened layer 50 may include a hard coating 60 applied to one or more surfaces of the base metal 46 of the profiled bar 12. The hard coating 60 may be applied to the outer surface 32, the first slot surface 34, the second slot surface 36, or combinations of these. In some embodiments, the hardened layer 50 may be the hard coating 60 applied over the entire peripheral surface of the profiled bar 12, including the outer surface 32, the first slot surface 34, and the second slot surface 36. In some embodiments, the hard coating 60 of the hardened layer 50 may be applied on at least 20%, at least 50%, at least 75%, at least 80%, at least 85%, at least 90%, at least 95%, or at least 99% of the surface area of the peripheral surfaces of the profiled bars 12. In some embodiments, the hard coating 60 of the hardened layer 50 may be applied to at least the first slot surface 34 and the second slot surface 36.

The hard coating 60 of the hardened layer 50 may be applied to the base metal 46 by known coating or spraying methods, such as but not limited to high-velocity oxygen fuel (HVOF) spraying, plasma spraying, laser spraying, chemical vapor deposition (CVD), physical vapor deposition (PVD), atomic layer deposition (ALD), electroplating, electroless plating (e.g., electroless nickel plating), ceramic coating, diamond-like carbon (DLC) coating, other coating methods, or combinations of methods. In some embodiments, the hard coating 60 may be applied using an HVOF process. The hard coating 60 may include compounds having a hardness greater than the hardness of the base metal 46. Examples of the hard coating 60 may include, but are not limited to, tungsten carbide, chromium carbide, titanium nitride, chromium nitride, electroless plated nickel, ceramic coatings, alumina, other hard coating materials, or combinations thereof. In some embodiments, the hard coating 60 may be a tungsten carbide coating. In some embodiments, the hardened layer 50 comprising a hard coating 60 may be titanium nitride or chromium nitride coating applied through a PVD process. In some embodiments, the hard coating 60 of the hardened layer 50 may a nickel layer applied using an electroless plating process. In some embodiments, the hard coating 60 may be a ceramic coating formed by applying a thin film of ceramic paint to one or more surfaces of the profiled bars 12 and firing the profiled bars at a temperature sufficient to cure the ceramic coating and bond the ceramic coating to the base metal 46.

The hard coating 60 may have a thickness of greater than or equal to 5 microns, greater than or equal to 10 microns, greater than or equal to 15 microns, or even greater than or equal to 20 microns. The hard coating 60 may have a thickness of less than or equal to 300 microns, less than or equal to 250 microns, less than or equal to 200 microns, less than or equal to 100 microns, or less than or equal to 50 microns. The hard coating 60 may have a thickness of from 5 microns to 300 microns, from 5 microns to 100 microns, or from 10 microns to 50 microns. The hard coating 60 may have a Vickers hardness value sufficient to reduce or prevent wear of the first slot surface 34 and/or the second slot surface 36. The hard coating 60 may have a Vickers hardness value that is greater than the Vickers hardness of the base metal 46. In some embodiments, the hard coating 60 may have a Vickers hardness value greater than the chrome layer 40. The hard coating 60 may have a Vickers hardness of greater than or equal to 500HV0.05, greater than or equal to 700HV0.05, greater than or equal to 900HV0.05, greater than or equal to 1000HV0.05, or even greater than or equal to 1100HV0.05.

Referring again to FIG. 5, as previously described herein, in some embodiments, the profiled bars 12 may include a chrome layer 40 disposed on the outer surface 32 of the profiled bar 12 or on the hardened layer 50. The chrome layer 40 may protect the outer surface 32 of the profiled bars 12 from wear and damage caused by the pressure pulsations from the rotor for clearing the oversized solid contaminants away from the slotted cylindrical wall 16 of the screen cylinder 10. In some embodiments, the outer surface 32 of each of the plurality of profiled bars 12 may include the hardened layer 50, and the chrome layer 40 may be disposed on the hardened layer 50. The chrome layer 40 may also be formed on one or more portions of the first slot surface 34, the second slot surface 36, or both. On the first slot surface 34 and the second slot surface 36, the chrome layer 40 may be deposited on top of the hardened layer 50.

The chrome layer 40 may have an average thickness sufficient to protect the outer surface 32 of the profiled bars 12 and withstand the pressure pulsations from the rotor. In some embodiments, the chrome layer 40 may have an average thickness greater than or equal to 10 microns, greater than or equal to 20 microns, greater than or equal to 30 microns, or even greater than or equal to 40 microns. The chrome layer 40 may have a maximum thickness at the outer surface 32 of the profiled bars 12. The thickness of the chrome layer 40 of each of the profiled bars 12 may decrease from the outer surface 32 towards the attachment end 30 of each of the profiled bars 12. The chrome layer 40 may have a Vickers hardness value of from about 900HV0.05 to about 1000HV0.05. In some embodiments, the profiled bars 12 may have a hardened layer 50 without a chrome layer 40. In some embodiments, the profiled bars 12 may be substantially free of chrome, such as having chrome on less than or equal to 5% of the peripheral surfaces of the profiled bars 12.

A method for making a hardened profiled bar 12 for a screen cylinder 10 may include providing a profiled bar 12 that includes the attachment end 30 and the outer surface 32 facing in a direction opposite the attachment end 30. The profiled bar 12 may include the first slot surface 34 extending from the outer surface 32 to the attachment end 30 of the profiled bar 12 and a second slot surface 36 opposite the first slot surface 34 and extending from the outer surface 32 to the attachment end 30. The method may further include forming the hardened layer 50 on or integral with at least a portion of the first slot surface 34, the hardened layer 50 having a Vickers hardness value greater than the Vickers hardness of the base metal 46. The hardened layer 50 may have a Vickers hardness value of greater than or equal to 500HV0.05, greater than or equal to 900HV0.05, greater than or equal to 1000HV0.05, greater than or equal to 1100HV0.05, or even greater than or equal to 1200HV0.05. The method may further include depositing the chrome layer 40 at least on the outer surface 32 of the profiled bar 12 or on the hardened layer 50. In some embodiments, the method may include forming the hardened layer 50 on portions of the outer surface 32, portions of the second slot surface 36, or both, in addition to the first slot surface 34.

In some embodiments, forming the hardened layer 50 may include subjecting at least the first slot surface 34 of the profiled bar 12 to a surface treatment in which one or more chemical compounds are diffused into the base metal 46 at the first slot surface 34. In some embodiments, the method may include forming the hardened layer 50 on the entire peripheral surface of the profiled bars 12, including the outer surface 32, the first slot surface 34, and the second slot surface 36, by subjecting the entire peripheral surface of the profiled bars 12 to the surface treatment. The method may include forming the hardened layer 50 on at least 25%, at least 50%, at least 75%, at least 80%, at least 85%, at least 90%, at least 95%, or at least 99% of the surface area of the peripheral surfaces of the profiled bars 12. The surface treatment may include contacting at least a portion of the profiled bars 12 with a nitrogen-containing gas at a temperature less than the annealing temperature of the base metal 46 and at a pressure sufficient to diffuse nitrogen or a nitrogen-containing compound into the base metal 46. The nitrogen-containing gas may include nitrogen gas, ammonia, or other nitrogen gas. In some embodiments, the surface treatment for forming the hardened layer 50 integral with the base metal 46 may include a nitriding process. The nitriding process may be conducted in accordance with any of the operating parameters previously discussed herein.

In some embodiments, forming the hardened layer 50 may include applying a hard coating 60 to at least the first slot surface 34 of the profiled bars 12. Applying the hard coating 60 may include any of the coating processes previously discussed herein, and the hard coating 60 may be any of the materials previously discussed herein. In some embodiments, applying a coating to at least the first slot surface 34 may include thermal spraying process. In some embodiments, the thermal spraying process may include a tungsten carbide high velocity oxygen-fuel (HVOF) process.

The method of producing the profiled bars 12 may include polishing the profiled bars 12 to prepare the hardened layer 50 for electroplating the chrome layer 40 thereon. The polishing may include known processes in the art for polishing metal components. The polishing step may be sufficient to prepare the surfaces for application of the chrome layer 40 but not so extensive that the hardened layer 50 is rendered ineffective or completely removed.

The method of making the profiled bars 12 may include forming the hardened layer 50 on the outer surface 32 of the profiled bar 12 and depositing the chrome layer 40 on the hardened layer outer surface 56 the hardened layer 50 formed on the outer surface 32 of the profiled bar 12. As previously discussed, the method may include a polishing step between forming the hardened layer 50 and depositing the chrome layer 40. The chrome layer 40 may be applied by an electroplating process.

As previously discussed herein, the screen cylinders 10 that include the profiled bars 12 having hardened layers 50 may be used to process solid suspensions of cellulose or other fibers in the pulp in paper industry, as described herein. However, the screen cylinders 10 may not be limited to use in the pulp and paper industry. For example, screen cylinders 10 of the present disclosure having the hardened profiled bars 12 may be used to screen solid suspensions and/or slurries to remove oversized solid contaminants in mining and drilling applications, food preparation and processing operations, water treatment processes, coating operations, and other industries.

Referring again to FIG. 1, in some embodiments, a method of removing oversized solid contaminants from a slurry or solid suspension may include contacting the slurry or solid suspension with a screen cylinder 10. The screen cylinder 10 may include the plurality of profiled bars 12 coupled to at least one support ring 14 and aligned longitudinally. The profiled bars 12 may have any of the characteristics or properties previously described herein. Referring to FIG. 5, in some embodiments, each of the plurality of profiled bars 12 may include the outer surface 32 facing away from the at least one support ring 14, the first slot surface 34 extending from the outer surface 32 to the attachment end 30 of the profiled bar 12 opposite the outer surface 32, and a second slot surface 36 opposite the first slot surface 34 and extending from the outer surface 32 to the attachment end 30 of the profiled bar 12. As previously discussed, each of the profiled bars may include the hardened layer 50 integral with or disposed on at least a portion of the first slot surface 34 of each of the profiled bars 12, the hardened layer 50 having a Vickers hardness value greater than the base metal 46, such as greater than or equal to 500HV0.05, greater than or equal to 900HV0.05, greater than or equal to 1000HV0.05, greater than or equal to 1100HV0.05, or even greater than or equal to 1200HV0.05. The first slot surfaces 34 and second slot surfaces 36 of side-by-side pairs of profiled bars 12 (e.g., pair of immediately adjacent profiled bars 12) define a plurality of slots 20 of the screen cylinder 10. Contact of the slurry or solid suspension with the screen cylinder may cause at least a portion of the slurry or solid suspension to pass through the slots 20. The method may further include collecting an acceptable portion of the slurry or solid suspension from the plurality of slots 20 of the screen cylinder 10. In some embodiments, the profiled bars 12 may further include the chrome layer 40 disposed on the outer surface 32 of the profiled bar 12 or on the hardened layer 50. In some embodiments, the method may further include removing at least a portion of the solid contaminants from the outer surfaces 32 of the plurality of profiled bars 12.

EXAMPLES

Embodiments of the present disclosure will be further clarified by the following examples, which should not be construed as limiting on the disclosed and/or claimed embodiments presently described.

Example 1

A plurality of stainless steel profiled bars for a screen cylinder were subjected to a nitrocarburizing process to produce a hardened layer integral with the surfaces of the profiled bars. The base metal of the profiled bars in Example 1 was 316L stainless steel. The nitrocarburizing process was accomplished by submersing the profiled bars in a molten salt bath maintained at a temperature in a range of from 370° C. to 540° C. for a period of time sufficient to form the hardened layer. The salt bath included cyanate ions for providing nitrogen and carbonate ions for providing carbon. The nitrocarburizing process produced a compound layer and a diffusion zone extending from the compound layer further into the base metal.

For Examples 1 and 2, the thickness of the compound layers and diffusion zones of nitrided samples were measured in accordance with ASTM B487-85 (2007). These thicknesses were measured under 1000× magnification. The Vickers hardness values were measured according to ASTM E384-11e1. For the diffusion zone in each nitrided bar, the Vickers hardness (HV) was measured on a transverse cross-section of the profiled bar with an indentor load of 0.05 kilograms of force (kgf). For the compound layer, the hardness test was conducted on the outer surface of the profiled bar after lightly polishing the outer surface with a 1 micron polishing medium. The indentor load was again 0.05 kgf. The Vickers hardness measurements were additionally converted to approximate Rockwell hardness (HRC) values using ASTM E140-12be1 equation X1.1.1. The average thickness, average Vickers hardness, and average HRC for the compound layer and diffusion layer for the hardened profiled bars of Example 1 are provided below in Table 1.

TABLE 1

| Location | Average Thickness (μm) | Average Vickers Hardness (HV0.05) | Average HRC |
|---|---|---|---|
| Compound Layer | 6 | 1017 | 69 |
| Diffusion Zone | 30 | 1169 | 71 |
| Total | 36 | N/A | N/A |

Additionally, the profiled bars of Example 1 were subjected to welding tests to evaluate the bonding of welds between the profiled bars and the end flanges of the screen cylinder. Portions of the profiled bars of Example 1 were welded to a stainless steel flange. No bonding issues with the welds were observed.

Corrosion tests were also performed on the profiled bars of Example 1. In a first corrosion test, a subset of the profiled bars of Example 1 were placed in water for a period of 20 days. No corrosion was apparent on the samples after 1 day submerged in water. After the 20 day period, the portions of the profiled bars of Example 1 submerged in water exhibited a layer of corrosion on the outer surface. Additionally, a second subset of the profiled bars of Example 1 was exposed to ambient air. After 430 days, the profiled bars exhibited small regions of corrosion on the outer surface.

Example 2

A second plurality of stainless steel profiled bars for a screen cylinder were subjected to a nitrocarburizing process to produce a hardened layer integral with the surfaces of the profiled bars. The base metal of the profiled bars in Example 1 was 316L stainless steel. The nitrocarburizing process was accomplished by submersing the profiled bars in a molten salt bath maintained at a temperature of from 370° C. to 540° C. for a period of time sufficient to form the hardened layer. The salt bath included cyanate ions for providing nitrogen and carbonate ions for providing carbon. The nitrocarburizing process produced a compound layer and a diffusion zone extending from the compound layer further into the base metal. The thickness, Vickers hardness, and HRC for the diffusion zone and compound layer were determined for each sample profiled bar according to the methods previously described in Example 1. The average thickness, average Vickers hardness, and average HRC for the compound layer and diffusion layer for the hardened profiled bars of Example 2 are provided below in Table 2.

TABLE 2

| Location | Average Thickness (μm) | Average Vickers Hardness (HV0.05) | Average HRC |
|---|---|---|---|
| Compound Layer | 5 | 695 | 60 |
| Diffusion Zone | 17 | 1228 | 72 |
| Total | 22 | N/A | N/A |

The profiled bars of Example 2 were also subjected to welding tests to evaluate the bonding of welds between the profiled bars and the end flanges of the screen cylinder. Portions of the profiled bars of Example 2 were welded to a stainless steel flange. No bonding issues with the welds were observed.

Corrosion tests were also performed on the profiled bars of Example 2. In a first corrosion test, a subset of the profiled bars of Example 2 were placed in water for a period of 20 days. No corrosion was apparent on the samples after 2 day submerged in water. After the 20 day period, the portions of the profiled bars of Example 2 submerged in water exhibited a layer of corrosion on the outer surface. Additionally, a second subset of the profiled bars of Example 2 was exposed to ambient air. After 430 days, the profiled bars exhibited small regions of corrosion on the outer surface.

Example 3

In Example 3, another plurality of stainless steel profiled bars for a screen cylinder were subjected to a nitriding process conducted in accordance with the NANO-S™ nitriding process provided by Nitrex Metals Inc. of Quebec, Canada to produce the hardened layer integral with the base metal. The nitriding process produced a compound layer and a diffusion zone extending from the compound layer further into the base metal. The thickness and Vickers hardness for the diffusion zone and compound layer were determined for each sample profiled bar of Example 3 according to the methods previously described in Example 1 and the results are provided below in Table 3.

TABLE 3

| Location | Average Thickness (μm) | Average Vickers Hardness (HV0.05) |
|---|---|---|
| Compound Layer | 6.9 | 994 |
| Diffusion Zone | 121 | 482 |
| Total | 127.9 | N/A |

Additionally, the surface roughness Ra of the hardened layer outer surface of the compound layer was measured to be 0.10 microns, which is comparable to the surface roughness of the bare untreated profiled bar, which had a surface roughness Ra of 0.09 microns.

Example 4

For Example 4, a plurality of stainless steel profiled bars were subjected to a tungsten carbide HVOF process to coat the profiled bar with a tungsten carbide coating. Thus, in Example 4, the hardened layer was a hard coating comprising tungsten carbide.

The thickness of the hard coatings of Example 4 were measured according to ASTM B487-85 (2007). For Example 4, the thickness was measured at a 500× magnification. The Vickers hardness values were measured according to ASTM E384-11e1. The Vickers hardness (HV) was measured on a transverse cross-section of the profiled bar with an indentor load of 0.1 kgf. The hardness testing was conducted in areas without large pores or shrinkage of the hard coating. The Vickers hardness measurements were additionally converted to approximate Rockwell hardness (HRC) values using ASTM E140-12be1 equation X1.1.1. The average thickness, average Vickers hardness, and average HRC for the hard coating on the profiled bars of Example 4 are provided below in Table 4.

TABLE 4

| Coating | Average Thickness (μm) | Average Vickers Hardness (HV) | Average HRC |
|---|---|---|---|
| Tungsten Carbide Coating | 31 | 1346 | 73 |

The profiled bars of Example 4 having the tungsten carbide coating exhibited greater average hardness compared to the profiled bars of Examples 1 and 2 having the hardened layer integral with the base metal. However, it was observed that the profiled bars of Example 4 having the tungsten carbide coating applied by HVOF exhibited surface roughness greater than the profiled bars of Examples 1 and 2, for which the hardened layer was formed integral with the base metal using a nitriding process. Additionally, the thickness of the hardened layer (i.e., tungsten carbide coating) of the profiled bars of Example 4 were not as consistent as the thicknesses of the hardened layers of the profiled bars of Examples 1 and 2.

Further, for the profiled bars of Example 4, a bonding test was conducted at the interface between the base metal and the tungsten carbide coating using an interface indentation method. In the interface indentation method, a Vickers indentations using loads of 0.1 kgf and 0.5 kgf were applied at the interface between the base metal and the tungsten carbide coating. In response to the interface indentation test, no visible cracks were observed at the interface at the indentation load of 0.1 kgf, however, at the indentation load of 0.5 kgf, some small cracks at the interface between the base metal and tungsten carbide coating were observed.

Example 5

In Example 5, the plurality of bars from Example 4 having the tungsten carbide coating applied via HVOF were electroplated with chrome to produce a chrome layer. The chrome layer was applied on top of the tungsten carbide coating. For Samples 5A, the electroplating process was conducted for a longer period of time, resulting in a thicker chrome layer. For Samples 5B, the electroplating time was reduced, resulting in a thinner chrome layer. The average thickness of the tungsten carbide coating was determined. Due to the inconsistency of the electroplating process, the thickness of the chrome layer was measured for Samples 5A and 5B at the thickest region of the chrome layer, the thinnest region of the chrome layer, and a middle thickness region of the chrome layer. Additionally, the Vickers hardness value for the tungsten carbide coating was measured according to the methods previously described herein. The thicknesses and Vickers hardness values for Samples 5A and 5B are provided below in Table 5.

TABLE 5

| Sample | Chrome Thickness (μm - thickest) | Chrome Thickness (μm - middle) | Chrome Thickness (μm - thinnest) | Tungsten Carbide Thickness (μm) | Average Vickers Hardness (HV) |
|---|---|---|---|---|---|
| 5A | 180 | 56 | 8 | 21 | 1317 |
| 5B | 163 | 46 | 6 | 20 | 1310 |

Comparative Example 6

In Comparative Example 6, the Vickers hardness values for a plurality of untreated profiled bars having a base metal of 316L stainless steel and no hardened layer or chrome layer were measured. The results for the Vickers hardness values for the profiled bars of Comparative Example 6 are provided below in Table 6.

Comparative Example 7

For Comparative Example 7, a plurality of profiled bars were electroplated with chrome to form a chrome layer with no hardened layer between the base metal and the chrome layer. The Vickers hardness values for the profiled bars of Comparative Example 7 were determined in accordance with test methods previous described herein. The Vickers hardness values for the profiled bars of Comparative Example 7 having the chrome layer and no hardened layer are provided in Table 6. Due to the inconsistency in the thickness of the chrome layer applied through electroplating, the Vickers hardness value for the chrome layer for each of the profiled bars of Comparative Example 7 was determined at a first area having a thicker chrome layer, a second area having a medium thickness chrome layer, and a third area having a thinner chrome layer.

TABLE 6

| Location | Coating | Average Vickers Hardness (HV) | Average HRC |
|---|---|---|---|
| Comparative | Untreated | 406 | 41.4 |

TABLE 6-continued

| Location | Coating | Average Vickers Hardness (HV) | Average HRC |
|---|---|---|---|
| Example 6 | | | |
| Comparative | Thick Chrome | 995 | 69 |
| Example 7 | Medium Chrome | 994 | 69 |
| | Thin Chrome | 991 | 69 |

The hardened profiled bars of Examples 1-5 all exhibited average Vickers hardness greater than the average Vickers hardness of Comparative Example 6, which was an untreated profiled bar. The hardened profiled bars of Examples 1 and 3-5 all had an average Vickers hardness comparable to or greater than the hardness of the profiled bars of Comparative Example 7 coated with a chrome coating. Thus, the hardened profiled bars, which are hardened by the methods disclosed herein, may have a hardness substantially greater than the base metal and comparable to or greater than a hardness of profiled bars having only a chrome layer deposited thereon.

A first aspect of the present disclosure may be directed to a screen cylinder that may comprise a plurality of profiled bars aligned longitudinally and coupled to at least one support ring at attachment ends of the plurality of profiled bars. Each of the plurality of profiled bars may comprise an outer surface facing away from the at least one support ring, a first slot surface extending from the outer surface to the attachment end of the profiled bar opposite the outer surface, and a second slot surface opposite the first slot surface and extending from the outer surface to the attachment end of the profiled bar. The first slot surface of one profiled bar and the second slot surface of another immediately adjacent profiled bar may define a slot. Each of the plurality of profiled bars may further comprise a hardened layer integral with or disposed on at least a portion of the first slot surface of the profiled bar. The hardened layer may have a Vickers hardness value greater than or equal to 500HV0.05, as determined in accordance with ASTM E384-11e1.

A second aspect of the present disclosure may include the first aspect, wherein the hardened layer may be disposed at portions of the second slot surface, the outer surface, or both, of each of the profiled bars.

A third aspect of the present disclosure may include either one of the first or second aspects, wherein the hardened layer may be disposed over an entire peripheral surface of each of the profiled bars, the entire peripheral surface including at least the outer surface, the first slot surface, and the second slot surface.

A fourth aspect of the present disclosure may include any one of the first through third aspects, wherein the hardened layer may have a hardened layer outer surface having a topography that is dimensionally consistent to within a tolerance of less than or equal to 9 microns (μm).

A fifth aspect of the present disclosure may include any one of the first through fourth aspects, wherein the hardened layer may have a Vickers hardness value of greater than or equal to 900HV0.05, as determined in accordance with ASTM E384-11e1.

A sixth aspect of the present disclosure may include any one of the first through fifth aspects, wherein the hardened layer may have an electrical conductivity that is the same as an electrical conductivity of a base metal of the plurality of profiled bars.

A seventh aspect of the present disclosure may include any one of the first through sixth aspects, wherein a base metal of each of the plurality of profiled bars may comprise stainless steel.

An eighth aspect of the present disclosure may include any one of the first through seventh aspects, wherein a base metal of each of the plurality of profiled bars may be non-annealed.

A ninth aspect of the present disclosure may include any one of the first through eighth aspects, further comprising a chrome layer disposed on the outer surface the profiled bar or on the hardened layer.

A tenth aspect of the present disclosure may include the ninth aspect, wherein a thickness of the chrome layer of each of the profiled bars may decrease from the outer surface towards the attachment end of each of the profiled bars.

An eleventh aspect of the present disclosure may include any one of the first through tenth aspects, wherein the hardened layer may comprise a surface treated layer of a base metal of the profiled bars.

A twelfth aspect of the present disclosure may include the eleventh aspect, wherein a depth of the surface treated layer of the base metal may be greater than or equal to 5 microns.

A thirteenth aspect of the present disclosure may include either one of the eleventh or twelfth aspects, wherein the surface treated layer may comprise at least nitride ions.

A fourteenth aspect of the present disclosure may include any one of the first through eighth aspects, wherein the outer surface of each of the plurality of profiled bars may comprise the hardened layer and a chrome layer is disposed on the hardened layer.

A fifteenth aspect of the present disclosure may include any one of the first through tenth aspects, wherein the hardened layer may be a hard coating applied to the at least a portion of the first slot surface of the profiled bar.

A sixteenth aspect of the present disclosure may include the fifteenth aspect, wherein a thickness of the hard coating is greater than or equal to 5 microns, or from 5 microns to 300 microns.

A seventeenth aspect of the present disclosure may include any one of the fifteenth or sixteenth aspects, where the hard coating may comprise tungsten carbide, chromium carbide, titanium nitride, chromium nitride, electroless plated nickel, ceramic coatings, alumina, or combinations thereof. The hard coating may be a tungsten carbide coating. The hard coating of the hardened layer may be a titanium nitride or chromium nitride coating applied through a PVD process. The hard coating of the hardened layer may be a nickel layer applied using an electroless plating process. The hard coating may be a ceramic coating.

An eighteenth aspect of the present disclosure may include any one of the first through seventeenth aspects, wherein the screen cylinder is operable to separate solid contaminants from a solid suspension.

A nineteenth aspect of the present disclosure may be directed to a profiled bar for a screen cylinder for separating solid contaminants from a solid suspension. The profiled bar may comprise an attachment end and an outer surface disposed at an end opposite the attachment end, a first slot surface extending from the outer surface to the attachment end of the profiled bar, a second slot surface opposite the first slot surface and extending from the outer surface to the attachment end, and a hardened layer integral with or disposed on at least a portion of the first slot surface, a portion of the second slot surface, or both. The hardened layer may have a Vickers hardness value greater than or equal to 500HV0.05, as determined in accordance with ASTM E384-11e1.

A twentieth aspect of the present disclosure may include the nineteenth aspect, wherein, when a plurality of the profiled bars are arranged longitudinally and side by side, the first slot surface of one profiled bar and the second slot surface of another immediately adjacent profiled bar may define a slot.

A twenty-first aspect of the present disclosure may include either one of the nineteenth or twentieth aspects, wherein the hardened layer may be disposed over an entire peripheral surface of each of the profiled bars. The entire peripheral surface may include at least 80% of the outer surface, the first slot surface, and the second slot surface.

A twenty-second aspect of the present disclosure may include any one of the nineteenth through twenty-first aspects, wherein the hardened layer may have a hardened layer outer surface having a topography that is dimensionally consistent to within a tolerance of less than or equal to 9 microns (μm).

A twenty-third aspect of the present disclosure may include any one of the nineteenth through twenty-second aspects, wherein the hardened layer may have a Vickers hardness value of greater than or equal to 900HV0.05, as determined in accordance with ASTM E384-11e1.

A twenty-fourth aspect of the present disclosure may include any one of the nineteenth through twenty-third aspects, wherein the hardened layer may have an electrical conductivity that is the same as an electrical conductivity of a base metal of the plurality of profiled bars.

A twenty-fifth aspect of the present disclosure may include any one of the nineteenth through twenty-fourth aspects, wherein a base metal of each of the plurality of profiled bars may comprise stainless steel.

A twenty-sixth aspect of the present disclosure may include any one of the nineteenth through twenty-fifth aspects, wherein a base metal of each of the plurality of profiled bars may be non-annealed.

A twenty-seventh aspect of the present disclosure may include any one of the nineteenth through twenty-sixth aspects, further comprising a chrome layer disposed on the outer surface or on the hardened layer.

A twenty-eighth aspect of the present disclosure may include the twenty-seventh aspect, wherein a thickness of the chrome layer may decrease from the outer surface towards the attachment end of the profiled bar.

A twenty-ninth aspect of the present disclosure may include any one of the nineteenth through twenty-eighth aspects, wherein the hardened layer may comprise a surface treatment of a base metal of the profiled bars to a depth within the base metal.

A thirtieth aspect of the present disclosure may include the twenty-ninth aspect, wherein the depth of the hardened layer may be greater than or equal to 5 microns.

A thirty-first aspect of the present disclosure may include either one of the twenty-ninth or thirtieth aspects, wherein the hardened layer may comprise at least nitride ions.

A thirty-second aspect of the present disclosure may include any one of the nineteenth through twenty-eighth aspects, wherein the outer surface may comprise the hardened layer and the chrome layer is disposed on top of the hardened layer.

A thirty-third aspect of the present disclosure may include any one of the nineteenth through twenty-eighth aspects, wherein the hardened layer may be a hard coating applied to a base metal.

A thirty-fourth aspect of the present disclosure may include the thirty-third aspect, wherein a thickness of the hard coating is greater than or equal to 5 microns, or from 5 microns to 300 microns.

A thirty-fifth aspect of the present disclosure may include any one of the thirty-third or thirty-fourth aspects, wherein the hard coating may comprise tungsten carbide, chromium carbide, titanium nitride, chromium nitride, electroless plated nickel, ceramic coatings, alumina, or combinations thereof. The hard coating may be a tungsten carbide coating. The hard coating of the hardened layer may be a titanium nitride or chromium nitride coating applied through a PVD process. The hard coating of the hardened layer may be a nickel layer applied using an electroless plating process. The hard coating may be a ceramic coating.

A thirty-sixth aspect of the present disclosure may include any one of the nineteenth through thirty-fifth aspects and may be directed to a screen cylinder comprising the profiled bar of any of the nineteenth through thirty-fifth aspects.

A thirty-seventh aspect of the present disclosure may include the thirty-sixth aspect, wherein the screen cylinder comprises a plurality of the profiled bars aligned longitudinally and coupled to at least one support ring at attachment ends of the plurality of profiled bars.

A thirty-eighth aspect of the present disclosure may be directed to a method of making a hardened profiled bar for a screen cylinder. The method may include providing a profiled bar that may include an attachment end and an outer surface facing in a direction opposite the attachment end, a first slot surface extending from the outer surface to the attachment end of the profiled bar, and a second slot surface opposite the first slot surface and extending from the outer surface to the attachment end. The method may further include forming a hardened layer on or integral with at least a portion of the first slot surface, wherein the hardened layer may have a Vickers hardness value of greater than or equal to 500HV0.05, as determined in accordance with ASTM E384-11e1.

A thirty-ninth aspect of the present disclosure may include the thirty-eighth aspect, further comprising depositing a chrome layer on the outer surface of the profiled bar or on the hardened layer.

A fortieth aspect of the present disclosure may include either one of the thirty-eighth or thirty-ninth aspects, comprising forming the hardened layer on portions of the outer surface, the second slot surface, or both.

A forty-first aspect of the present disclosure may include any one of the thirty-eighth through fortieth aspects, wherein forming the hardened layer may comprise subjecting at least the first slot surface of the profiled bar to a surface treatment in which one or more chemical compounds are diffused into a base metal at the first slot surface.

A forty-second aspect of the present disclosure may include the forty-first aspect, wherein the surface treatment may comprise contacting at least a portion of the profiled bar with a nitrogen-containing gas or a nitrogen-containing liquid bath at a temperature less than the annealing temperature of the base metal and at a pressure sufficient to diffuse nitrogen or nitrogen-containing compounds into the base metal.

A forty-third aspect of the present disclosure may include any one of the thirty-eighth through fortieth aspects, wherein forming the hardened layer may comprise applying a coating to at least the first slot surface of the profiled bar.

A forty-fourth aspect of the present disclosure may include the forty-third aspect, wherein applying a coating to at least the first slot surface may comprise a thermal spraying process.

A forty-fifth aspect of the present disclosure may include the forty-fourth aspect, wherein the thermal spraying process may comprise a tungsten carbide high velocity oxygen-fuel (HVOF) process.

A forty-sixth aspect of the present disclosure may include the forty-third aspect, wherein forming the hardened layer may comprise applying a thin film of ceramic paint to one or more surfaces of the profiled bars, and firing the profiled bars at a temperature sufficient to form a ceramic coating and bond the ceramic coating to a base metal of the profiled bars.

A forty-seventh aspect of the present disclosure may include any one of the thirty-eighth through forty-sixth aspects, comprising forming the hardened layer on the outer surface of the profiled bar, and depositing the chrome layer on a hardened layer outer surface of the hardened layer formed on the outer surface of the profiled bar.

A forty-eighth aspect of the present disclosure may include the forty-seventh aspect, wherein a thickness of the chrome layer may decrease from the outer surface towards the attachment end of the profiled bar.

A forty-ninth aspect of the present disclosure may be directed to a method of removing solid contaminants from a solid suspension. The method may include contacting the solid suspension with a screen cylinder. The screen cylinder may include a plurality of profiled bars coupled to at least one support ring and aligned longitudinally. Each of the plurality of profiled bars may comprise an outer surface facing away from the at least one support ring, a first slot surface extending from the outer surface to an attachment end of the profiled bar opposite the outer surface, a second slot surface opposite the first slot surface and extending from the outer surface to the attachment end of the profiled bar, and a hardened layer integral with or disposed on at least a portion of the first slot surface of each of the profiled bars. The hardened layer may have a Vickers hardness value greater than or equal to 500HV0.05, as determined in accordance with ASTM E384-11e1. The first slot surfaces and second slot surfaces of side-by-side pairs of profiled bars may define a plurality of slots of the screen cylinder, and contact of the solid suspension with the screen cylinder may cause at least a portion of the solid suspension to pass through the slots. The method may further include collecting an acceptable solid suspension from the plurality of slots of the screen cylinder.

A fiftieth aspect of the present disclosure may include the forty-ninth aspect, further comprising removing at least a portion of the solid contaminants from the outer surfaces of the plurality of profiled bars.

A fifty-first aspect of the present disclosure may include either one of the forty-ninth or fiftieth aspects, wherein each of the plurality of profiled bars may comprise a chrome layer deposited on the outer surface of the profiled bars or on the hardened layer.

A fifty-second aspect of the present disclosure may include any one of the forty-ninth through fifty-first aspects, wherein the hardened layer may comprise a surface treated layer of a base metal of the profiled bars.

A fifty-third aspect of the present disclosure may include any one of the forty-ninth through fifty-first aspects, wherein the hardened layer may be a hard coating applied to the at least a portion of the first slot surface of the profiled bar.

While various embodiments of the profiled bars 12 for the screen cylinder 10 and methods for making and using the profiled bars 12 have been described herein, it should be understood that it is contemplated that each of these embodiments and techniques may be used separately or in conjunction with one or more embodiments and techniques. It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. A screen cylinder comprising:

a plurality of profiled bars aligned longitudinally and coupled to at least one support ring at attachment ends of the plurality of profiled bars, each of the plurality of profiled bars comprising:

an outer surface facing away from the at least one support ring;

a first slot surface extending from the outer surface to the attachment end of the profiled bar opposite the outer surface;

a second slot surface opposite the first slot surface and extending from the outer surface to the attachment end of the profiled bar, wherein the first slot surface of one profiled bar and the second slot surface of another immediately adjacent profiled bar define a slot; and a hardened layer integral with at least a portion of the first slot surface of the profiled bar, the hardened layer having a Vickers hardness value greater than or equal to 500HV0.05, as determined in accordance with ASTM E384-11e1, wherein the hardened layer comprises a surface treated layer of a base metal of the profiled bars.

2. The screen cylinder of claim 1, wherein the hardened layer is disposed at portions of the second slot surface, the outer surface, or both, of each of the profiled bars.

3. The screen cylinder of claim 1, wherein:

the hardened layer is disposed over an entire peripheral surface of each of the profiled bars, the entire peripheral surface including at least the outer surface, the first slot surface, and the second slot surface.

4. The screen cylinder of claim 1, wherein the hardened layer has a hardened layer outer surface having a topography that is dimensionally consistent to within a tolerance of less than or equal to 9 microns (μm).

5. The screen cylinder of claim 1, wherein the hardened layer has a Vickers hardness value of greater than or equal to 900HV0.05, as determined in accordance with ASTM E384-11e1.

6. The screen cylinder of claim 1, wherein the hardened layer has an electrical conductivity that is the same as an electrical conductivity of a base metal of the plurality of profiled bars.

7. The screen cylinder of claim 1, wherein: a base metal of each of the plurality of profiled bars comprises stainless steel, the base metal of each of the plurality of profiled bars is non-annealed, or both.

8. The screen cylinder of claim 1, further comprising a chrome layer disposed on the outer surface the profiled bar or on the hardened layer, wherein a thickness of the chrome layer of each of the profiled bars decreases from the outer surface towards the attachment end of each of the profiled bars.

9. The screen cylinder of claim 1, wherein the outer surface of each of the plurality of profiled bars comprises the hardened layer and a chrome layer is disposed on the hardened layer.

10. The screen cylinder of claim 1, wherein the outer surface of each of the plurality of profiled bars comprises the hardened layer and a hard coating applied to the at least a portion of the first slot surface of the profiled bar.

11. The screen cylinder of claim 10, wherein a thickness of the hard coating is greater than or equal to 5 microns.

12. The screen cylinder of claim 10, wherein the hard coating comprises tungsten carbide, chromium carbide, titanium nitride, chromium nitride, electroless-plated nickel, ceramic coating, alumina, or combinations thereof.

13. The screen cylinder of claim 10, wherein the hard coating comprises a ceramic coating.

14. The screen cylinder of claim 1, wherein a depth of the surface treated layer of the base metal is greater than or equal to 5 microns.

15. The screen cylinder of claim 1, wherein the surface treated layer comprises at least nitride ions.

16. A screen cylinder comprising:

a plurality of profiled bars aligned longitudinally and coupled to at least one support ring at attachment ends of the plurality of profiled bars, each of the plurality of profiled bars comprising:

an outer surface facing away from the at least one support ring;

a first slot surface extending from the outer surface to the attachment end of the profiled bar opposite the outer surface;

a second slot surface opposite the first slot surface and extending from the outer surface to the attachment end of the profiled bar, wherein the first slot surface of one profiled bar and the second slot surface of another immediately adjacent profiled bar define a slot; and a hardened layer disposed on at least a portion of the first slot surface of the profiled bar, the hardened layer having a Vickers hardness value greater than or equal to 500HV0.05, as determined in accordance with ASTM E384-11e1, wherein the hardened layer is disposed directly on at least a portion of the first slot surface of the profiled bar and the hardened layer is an outer layer.

* * * * *